US009764177B2

(12) United States Patent
Baudhuin et al.

(10) Patent No.: US 9,764,177 B2
(45) Date of Patent: Sep. 19, 2017

(54) PHYSICAL FITNESS TRAINING SYSTEM

(71) Applicant: Mad Dogg Athletics, Inc., Venice, CA (US)

(72) Inventors: John R. Baudhuin, Venice, CA (US); John C. Cook, Venice, CA (US); Ron Gibson, Venice, CA (US); Chris Camacho, Venice, CA (US); Mark L. Livingston, Venice, CA (US)

(73) Assignee: MAD DOGG ATHLETICS, INC., Venice, CA (US)

( * ) Notice: Subject to any disclaimer, the term of this patent is extended or adjusted under 35 U.S.C. 154(b) by 0 days.

(21) Appl. No.: 14/675,546

(22) Filed: Mar. 31, 2015

(65) Prior Publication Data

US 2016/0287922 A1 Oct. 6, 2016

(51) Int. Cl.
*A63B 21/00* (2006.01)
*A63B 21/012* (2006.01)
(Continued)

(52) U.S. Cl.
CPC ..... *A63B 21/00185* (2013.01); *A63B 21/012* (2013.01); *A63B 21/068* (2013.01); *A63B 21/151* (2013.01); *A63B 21/154* (2013.01); *A63B 21/16* (2013.01); *A63B 21/4017* (2015.10); *A63B 21/4043* (2015.10); *A63B 23/03533* (2013.01); *A63B 23/1209* (2013.01); *A63B 21/00181* (2013.01); *A63B 21/018* (2013.01); *A63B 21/0552* (2013.01);
(Continued)

(58) Field of Classification Search
CPC ..... A63B 7/00; A63B 7/02; A63B 21/00185; A63B 21/04; A63B 21/0442; A63B 21/055; A63B 21/0552; A63B 21/0555; A63B 21/068; A63B 21/151; A63B 21/153; A63B 21/154; A63B 21/155; A63B 21/156; B66D 3/10
USPC ..... 482/132; 188/64
See application file for complete search history.

(56) References Cited

U.S. PATENT DOCUMENTS 210,281 A * 11/1878 Weston ..... B66D 3/10 188/64
3,851,874 A * 12/1974 Wilkin ..... A63B 21/00196 482/129
(Continued)

FOREIGN PATENT DOCUMENTS

DE 42 22 484 11/1992

OTHER PUBLICATIONS www.purmotion.net/airfit-trainer-pro, Airfit Trainer Pro, Dec. 8, 2014, 3 pages.
(Continued)

*Primary Examiner* — Sundhara Ganesan
*Assistant Examiner* — Andrew S Lo
(74) *Attorney, Agent, or Firm* — WPAT, P.C., Intellectual Property Attorneys; Anthony King

(57) ABSTRACT

A pulley training system including a pulley wheel and a pulley housing, configured to receive a cord over the pulley wheel, and including one or more support attachment points. A radial pulley lock for use with a training pulley system. A sliding knot enclosure for use with a training pulley system. A training pulley system adapted for use with one or more of a variety of types of pulley cords, and with rope adjuster mechanisms to operate with such types of pulley cords.

18 Claims, 28 Drawing Sheets

(51) Int. Cl.

| | |
|---|---|
| ***A63B 21/068*** | (2006.01) |
| ***A63B 23/12*** | (2006.01) |
| *A63B 21/018* | (2006.01) |
| *A63B 69/20* | (2006.01) |
| *A63B 71/00* | (2006.01) |
| *A63B 21/055* | (2006.01) |
| *A63B 21/072* | (2006.01) |
| *A63B 21/16* | (2006.01) |
| *A63B 23/02* | (2006.01) |
| *A63B 23/035* | (2006.01) |
| *A63B 23/04* | (2006.01) |
| *A63B 71/06* | (2006.01) |
| *A63B 23/00* | (2006.01) |

(52) U.S. Cl.

CPC ..... *A63B 21/072* (2013.01); *A63B 21/0726* (2013.01); *A63B 21/169* (2015.10); *A63B 21/1645* (2013.01); *A63B 21/1681* (2013.01); *A63B 21/4049* (2015.10); *A63B 23/0216* (2013.01); *A63B 23/0355* (2013.01); *A63B 23/03508* (2013.01); *A63B 23/047* (2013.01); *A63B 23/0494* (2013.01); *A63B 23/1218* (2013.01); *A63B 69/20* (2013.01); *A63B 71/0054* (2013.01); *A63B 2023/003* (2013.01); *A63B 2071/0694* (2013.01); *A63B 2225/093* (2013.01)

(56) References Cited

U.S. PATENT DOCUMENTS 4,060,240 A * 11/1977 Dunston ..... A63B 23/0355 482/131
4,205,839 A * 6/1980 Best ..... A63B 21/154 294/169
4,667,625 A * 5/1987 Malone ..... A01K 27/005 119/785
4,884,800 A * 12/1989 Duke ..... A63B 21/154 482/111
4,934,484 A * 6/1990 Green ..... A62B 1/14 182/5
5,795,274 A 8/1998 Kasbohm
6,095,282 A * 8/2000 Sadeck ..... A62B 1/04 182/191
6,309,328 B1 * 10/2001 Dudley ..... A63B 21/018 482/114
6,612,972 B1 9/2003 Reichard
6,662,651 B1 12/2003 Roth
6,921,354 B1 7/2005 Shifferaw
7,044,896 B2 5/2006 Hetrick
7,087,001 B1 8/2006 Ihli
7,090,622 B2 8/2006 Hetrick
7,419,138 B1 * 9/2008 Mauthner ..... B66D 3/08 254/391
7,651,448 B2 1/2010 Hetrick
7,722,508 B2 5/2010 Hetrick
7,762,932 B2 7/2010 Hetrick
7,785,244 B2 8/2010 Hetrick
7,806,814 B2 10/2010 Hetrick
8,043,197 B2 10/2011 Hetrick
8,083,653 B2 12/2011 Hetrick
8,088,053 B2 * 1/2012 Whyatt ..... A63B 21/018 482/143
8,152,704 B2 * 4/2012 Brice ..... A63B 21/00 482/129
8,210,502 B2 * 7/2012 Fogg ..... E21B 33/072 254/406
D669,945 S 10/2012 Russo et al.
8,439,810 B2 5/2013 Baudhuin
8,469,864 B2 6/2013 Hetrick
8,628,059 B2 1/2014 Hetrick et al.
8,672,817 B2 3/2014 Bowser et al.
8,708,873 B2 4/2014 Birch et al.
D710,956 S 8/2014 Hetrick et al.
8,840,532 B2 9/2014 Hetrick et al.
8,997,928 B1 * 4/2015 Ellis ..... E06C 7/186 182/36
9,155,931 B2 10/2015 Hetrick
9,199,119 B2 12/2015 Hetrick et al.
9,326,908 B2 * 5/2016 Scott ..... A61H 1/02
2006/0063652 A1 * 3/2006 Berman ..... A63B 21/0004 482/139
2006/0264302 A1 * 11/2006 Sjodin ..... A63B 21/068 482/91
2007/0161472 A1 * 7/2007 Drechsler ..... A63B 15/00 482/100
2008/0011543 A1 * 1/2008 Klingler ..... A62B 1/18 182/5
2010/0051381 A1 * 3/2010 Wydner ..... A62B 35/04 182/5
2011/0287906 A1 11/2011 Morris
2012/0277074 A1 11/2012 Zeldakov
2014/0005015 A1 * 1/2014 Hester ..... A63B 21/154 482/131
2015/0090196 A1 * 4/2015 Fleming ..... B66D 1/7415 119/795

OTHER PUBLICATIONS www.trxtraining.com/suspension-training, TRX, Dec. 8, 2014, 5 pages.

* cited by examiner

PIN DISENGAGED

PIN ENGAGED

PIN DISENGAGED

PIN ENGAGED

PIN DISENGAGED

PIN ENGAGED

PIN DISENGAGED

PIN ENGAGED

PIN DISENGAGED

PIN ENGAGED

PIN DISENGAGED

PIN ENGAGED

SECTION A-A

PHYSICAL FITNESS TRAINING SYSTEM

FIELD OF THE INVENTION

The present invention relates to physical fitness training systems and devices, including systems which involve the user's body weight as a form of resistance, and systems including pulley-based devices and devices that may be readily adjusted.

BACKGROUND OF THE INVENTION

Various types of exercise and physical fitness training systems have existed for some time. For example, free weights and weight machines have existed for years. Recently, however, various forms of training where the user's body weight is used as a form of resistance have been developed. Such systems, however, have various shortcomings.

For example, suspension training systems generally include locked or static anchor points. This means the anchor point either is individually locked (e.g., gym rings or JungleGym™) or attached at a central anchor pivot point with little to no movement (e.g., TRX®. This locked or static anchor point can restrict the extent to which handles may move during exercises. With a static or locked anchor point and thereby locked or static handles, most exercises involve moving the body around the handle, rather than the handle moving around the body. This means that the body must actively move around a set focal point to enable the user to perform the desired exercise movement (e.g., biceps curls, chest presses or lateral rows).

Furthermore, most exercise movements with static or locked anchors are performed primarily in the sagittal plane. This is a shortcoming when compared to movements performed with a free moving or unstable anchor which may allow movements in one or all three planes of motion during a single exercise movement (e.g., lateral rows with partial rotation or chest presses with rotation).

As another example, some existing pulley training systems control the rotational motion of the pulley. U.S. Pat. Application Pub. No. 2011/0287906 to Morris discloses a pulley exercise system including a means to adjust resistance to change the force required to rotate the pulley wheel about its axis. The adjustment means involves clamping on the cable between the pulley wheel and a brake extension or brake bar. However, Morris does not disclose a convenient way to fix the cable in place so that the pulley may be locked in a locked mode. In Morris, even if the brake extension or brake bar were configured to extend sufficiently to do so, a user may not be able to supply the required force and/or such force may damage the cable and/or such force may cause the brake extension or brake bar to become jammed.

U.S. Pat. No. 8,152,704 to Brice et al., which is incorporated herein by reference, disclosed a pulley training system that addressed the foregoing shortcomings. First, the pulley training system disclosed in the '704 patent includes an attachment brace that allows an attachment strap to slide through it during use. Second, the pulley training system disclosed in the '704 patent includes a locking pin that may extend through holes in the pulley housing's front and rear faces that are aligned with a hole in the pulley wheel. The pulley wheel is substantially prevented from rotating when the locking pin is engaged through the aligned holes, and can rotate freely when the locking pin is not so engaged.

However, other issues exist with pulley training systems. One issue regards controlling the length and/or positioning of the ends of the cord that engages the pulley wheel. To address this issue, some pulley training systems have attempted to shorten the length of the pulley cord by integrating a knot such as the lanyard hitch knot, or have utilized a separate cord which attaches to the pulley cord with a knot such as a Prusik knot (e.g., U.S. Pat. No. 8,088,053 to Whyatt et al.), and which attaches to an attachment point, user interface (e.g., a handle, foot cradle, etc.) or counterweight. But in these systems, the knot and separate cord may be difficult to manage. For example, there is difficulty in changing the position of the knot on the pulley cord. Additionally, users may face difficulties in learning how to tie and actually tying a lanyard hitch knot. This may be rather challenging to facilitate and/or manage in a class or group exercise setting.

Another issue with pulley training systems regards the cord or rope that is typically used to engage the pulley. Cords and ropes generally have a round cross-section. Certain uses of pulley training systems, however, involve rotational movements that may cause a pulley used with a cord having a round cross-section to undesirably twist during such movements. While pulley cords having non-round cross-sections, such as belts, have been used in stationary exercise equipment stations (e.g., the Pulsefitness® Multi-Pulley), it does not appear that such belts have been configured for use in pulley training systems. It also does not appear that existing pulley training systems have been configured to accommodate such non-circular cross-sectional belts or other devices.

Another issue with pulley training systems that use or incorporate a locking pin that is secured to the pulley training system by means of a lanyard is that such attachment lanyards may break. If locking pins become detached from their lanyards, they may be lost, thereby negating the ability to lock the pulley system.

Accordingly, a need exists for a fitness training system to address the foregoing shortcomings. A need also exists for various components for use with fitness training systems.

SUMMARY OF THE INVENTION

The current invention addresses the foregoing and other shortcomings as described herein. The current invention regards a training system comprising several inventive aspects.

Generally, the training system may include a pulley assembly with a pulley wheel, and a pulley cord which engages the pulley wheel. The pulley assembly may include a pulley engagement system so that the system may be used with the pulley wheel in a freely rotating state and also a non-rotating state, which permits different types of exercises. The pulley housing may also include various attachment points to accommodate mounting the system and/or performing different exercises. The cord, belt, webbing or other type of line used to engage the pulley wheel may include a device to adjust the cord's length. To this end, the adjustment device may comprise an adjustable knot within a sliding or moveable enclosure, which may allow the cord to be adjusted to permit different types of exercises.

In a first aspect of the invention, a pulley assembly for the training system is described. The pulley assembly preferably includes a pulley engagement system that is readily accessible to the user, and that allows the user to readily engage, fasten, or prevent movement of the pulley wheel in relation to the pulley housing, and to disengage or allow the pulley wheel to move freely which permits different types of exercises to be performed. In a preferred embodiment, the pulley engagement system may be a radial engagement mechanism. The pulley engagement system, being in a radial orientation allows the engagement of the pulley system to occur from preferably below or to the side of the pulley wheel radius.

The pulley assembly may comprise a pulley housing; a pulley wheel rotatably connected to the pulley housing and having a circumferential edge configured to receive a cord, the circumferential edge including at least one female opening configured to receive a male member; a male member positioned proximate to the pulley wheel's circumferential edge and movably attached to the pulley housing, wherein the male member has a range of motion that extends radially into and out of engagement with a female opening on the pulley wheel when the pulley wheel is rotated to a position in which the female opening is aligned with the male member; and a pulley engagement system configured to secure the male member relative to the pulley housing when the male member is engaged with a female opening on the pulley wheel. The circumferential edge of the pulley wheel preferably has at least one serrated, raised, or gripping section substantially in the same position as the female opening of the pulley wheel. Such gripping section may be placed on the pulley wheel to substantially assist in preventing the pulley cord from slipping or sliding over the face of the pulley wheel even when the pulley engagement system is engaged or non-moving, thereby allowing users of the pulley training system to receive a safer exercise experience.

The pulley assembly may thus have a static or non-moving mode in which the pulley wheel is substantially prevented from rotating relative to the pulley housing, and an open or moving mode in which the pulley wheel may rotate freely relative to the pulley housing. The pulley assembly may thus allow different exercises in the static and open modes.

In a second aspect of the invention, a feature that allows the pulley cord to be readily adjusted is described. To this end, the pulley cord may be adjusted using an adjustment cord and an adjustable or sliding enclosure that allows a user to readily shorten or lengthen the effective useable length of the pulley cord, to accommodate the height of the user, to permit different types of exercises and/or to allow the training system to be connected to an anchor point having a particular height.

The adjustment cord is preferably attached onto the pulley cord (such as with a Prusik knot), with the adjustable or sliding enclosure preferably enclosing the attached portion of the adjustment cord, and having an aperture through which part of the adjustment cord may extend for attachment to a handle, foot cradle, arm cradle, or a counterweight item (such as a dumbbell, kettlebell, sandbag, etc.), anchor point, etc. The adjustment cord and/or adjustable or sliding enclosure preferably engage or interface with, and disengage or slide, on the pulley rope readily, and may be configured so that a user does not have to remove anything from, or add anything to, the pulley cord in order to effect an adjustment. The adjustment cord and adjustable or sliding enclosure may be attached to the pulley cord in a way that they remain attached to the pulley system during use. This omits the need for the user to attempt to tie a knot onto the pulley cord in order to adjust the height of the system or location of attachments. This reduces the time needed between exercises, and decreases risk of injury that could arise from improperly tying an adjustment knot.

In a third aspect of the invention, different types of pulley cords that may engage the pulley wheel are described, including those having circular cross-sections and non-circular cross-sections. For example, an oversized cord or rope having a relatively large diameter may be used which provides additional safety and ergonomic benefits. As another example, the pulley cord may have a non-circular cross-section, such as a V-belt or a flat webbing. In either case, the cross-section of the pulley may be reconfigured to engage the particular cord used. Wider-profile cross-section cords like belts or webbing, along with the correspondingly modified pulley, may provide enhanced stability for exercises that may benefit from a wider more stable platform, such as for rotational bodyweight exercises that are part of a rehabilitative protocol or regimen. Such belts or webbing and corresponding pulley wheels may also benefit users who may require a more stabilized overall pulley system (e.g., older users, less experienced fitness users, etc.).

In a fourth aspect of the invention, a training system that is flexible to permit a variety of different types of exercises is described. To this end, the training system may permit exercises where the pulley cord travels or is stationary. The training system also permits other exercises such as pull-ups, assisted pull-ups, leg lifts, knee raises, assisted leg lifts, and assisted knee raises due to the holes in, and the configuration of, its pulley housing.

In a fifth aspect of the invention, a pulley training system is described which reflects aesthetic appeal, which may entice a user to exercise. To this end, the pulley assembly and housing reflects a smooth and free flowing appearance which is separate and apart from any functional requirements of the system. The components of the training system preferably complement each other to provide a unique shape, style and overall appearance. In addition to these aesthetic elements, coloring and guiding features are preferably included so that during the operation and use of the pulley system, different stages of engagement or disengagement of the pulley wheel are visually apparent. The use of colors may also lend a bold appearance to the training system thereby enticing users to exercise with it. Separate from their appearance, these aesthetic and visual elements offer the user better ease of use and better knowledge of their safety when approaching or using the pulley training system.

Other features and advantages of the invention will become apparent from the following detailed description of the preferred embodiments taken with the accompanying drawings, which illustrate, by way of example, the principles of the invention.

BRIEF DESCRIPTION OF THE DRAWINGS

Embodiments of the present invention will now be described, by way of example only, with reference to the following drawings.

DETAILED DESCRIPTION OF THE PREFERRED EMBODIMENTS

Referring to FIGS. 1, 2, 4A, 4B, 11, 13A, and 13B, a training system 2 according to the present invention is first generally described.

Figure 1:
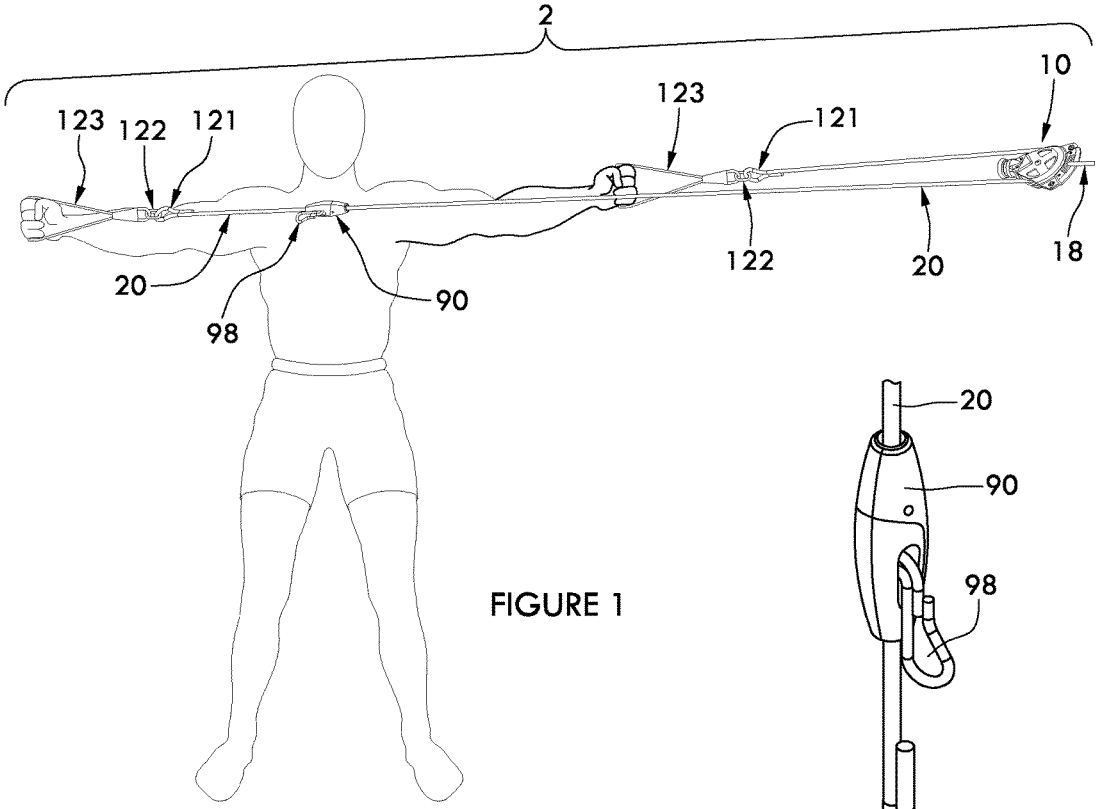
FIG. 1 is a perspective view of a training system including a pulley assembly, a pulley cord, an adjustment cord with an enclosure, being used by a person.

As shown in FIG. 1, bodyweight and other types of exercises may be performed with the system 2. In general, the system 2, may include pulley assembly 10, and cord adjustment device 90. As shown in the figures, the pulley assembly 10 may contain or house a pulley wheel 12. A pulley cord 20 may enter the pulley assembly 10 at entrance or opening 47A, wrap around or engage part of the pulley 12, and exit at opening 47B. The pulley assembly 10 may include a pulley engagement system 70, which may face downward so that it is readily accessible to the user, to switch the pulley wheel 12 from a disengaged and rotating state to an engaged and non-rotating state.

The pulley engagement system 70 allows the pulley assembly 10 to operate with the pulley wheel either in an unsecured or secured position. These positions are respectively shown in, for example, FIGS. 4A and 4B, FIGS. 5A and 5B, FIGS. 6A and 6B, and FIGS. 7A and 7B. In each of these pairs of figures, the disengaged position may be discerned because the knob 80 is displaced downward by a distance from the pulley housing 16; while in the engaged position, the knob 80 is relatively adjacent to the pulley housing 16. The gap between the pulley housing 16 and the knob 80 while in the disengaged position is preferably a visible indicator.

The disengaged or freely rotating or unsecured mode, and the engaged or non-rotating or secured mode, permit the user to perform different types of exercises. When disengaged, the pulley wheel 12 may rotate so that the pulley cord 20 travels during the exercise. When engaged or fixed, the pulley wheel 12 may be held in a non-moving position so that the pulley cord 20 is significantly unable to or does not travel during the exercise.

Figure 4A:
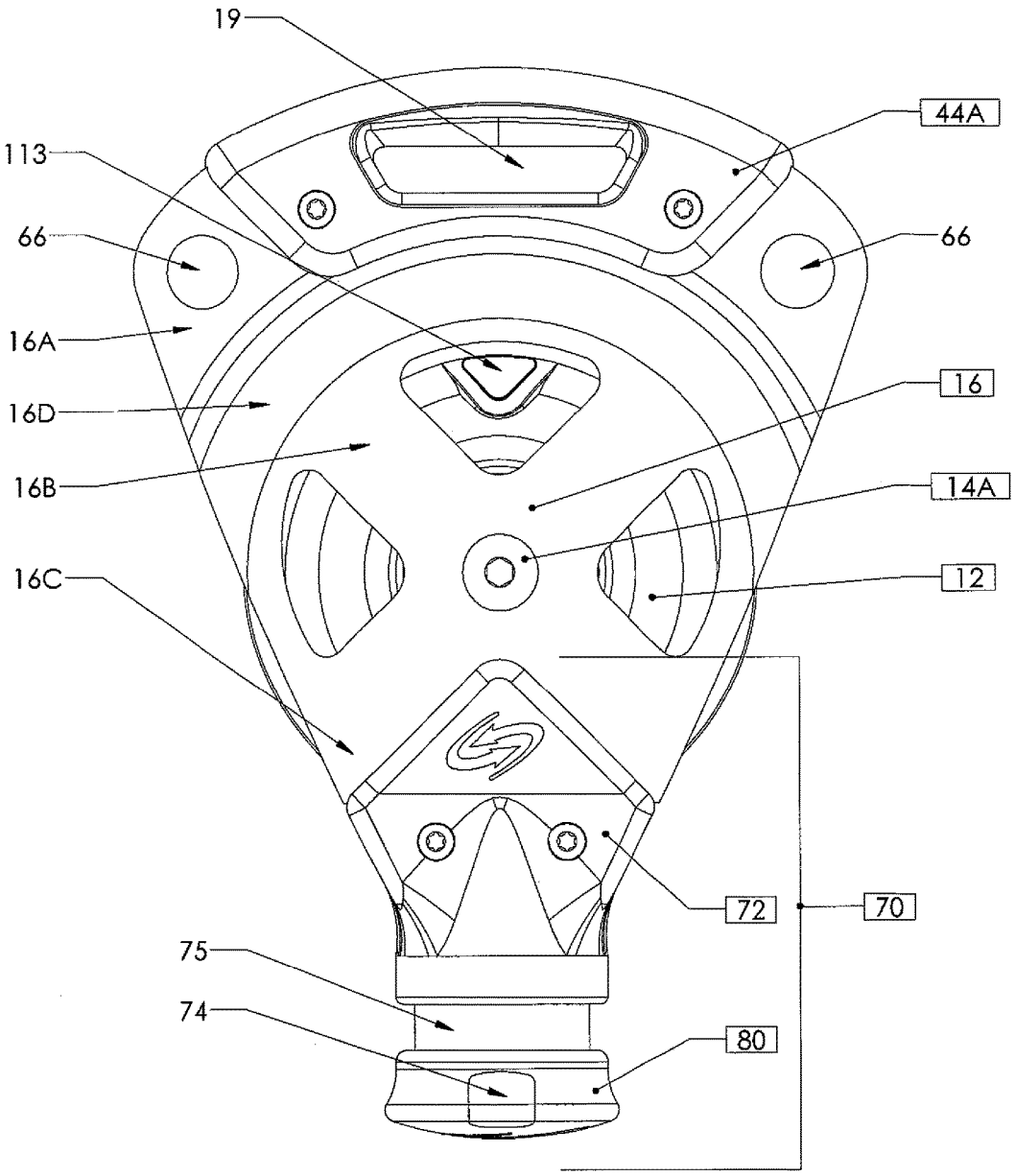
FIG. 4A is a front view of a pulley assembly in a disengaged position.
Figure 4B:
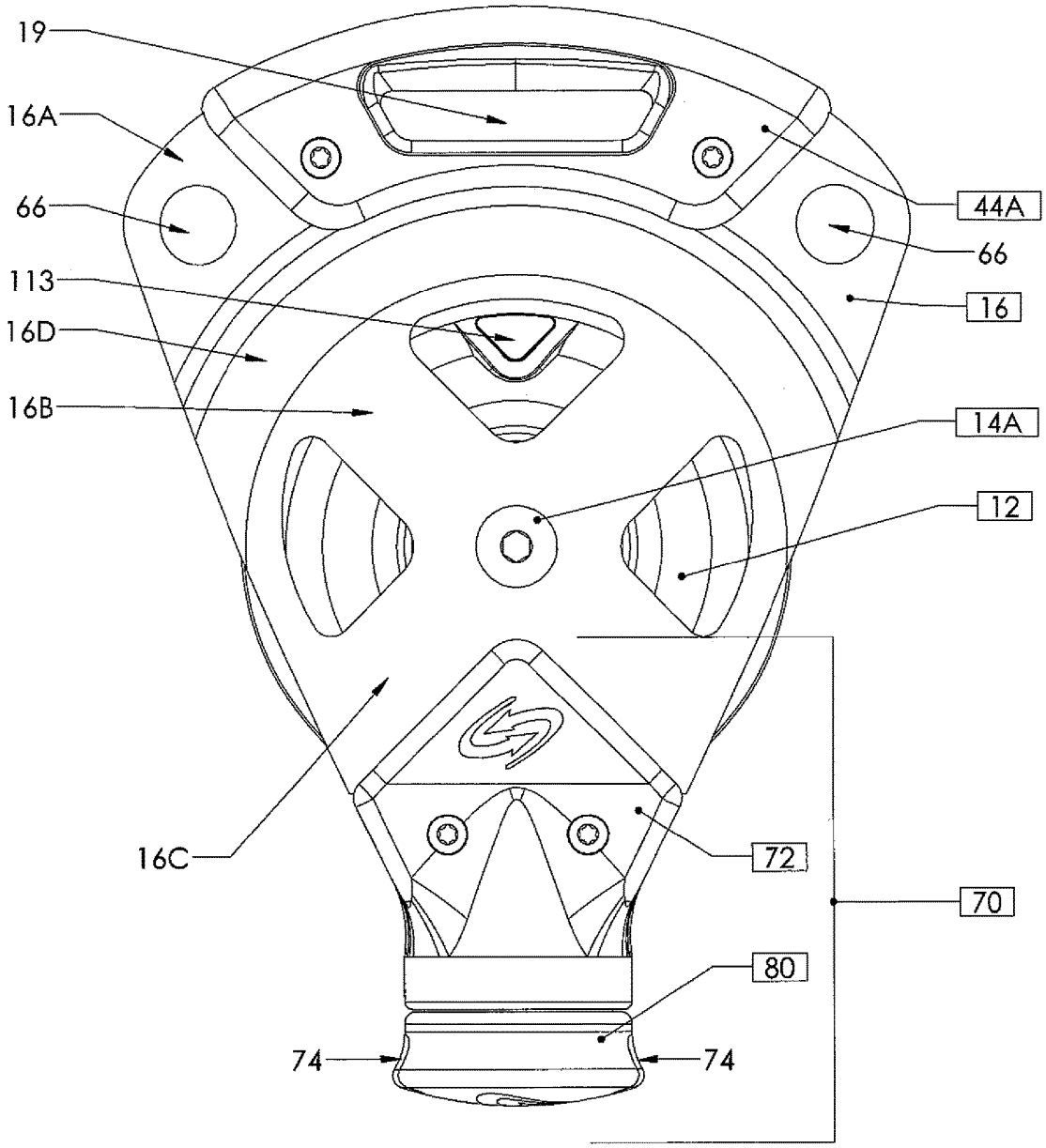
FIG. 4B is a front view of a pulley assembly in an engaged position.
Figure 5A:
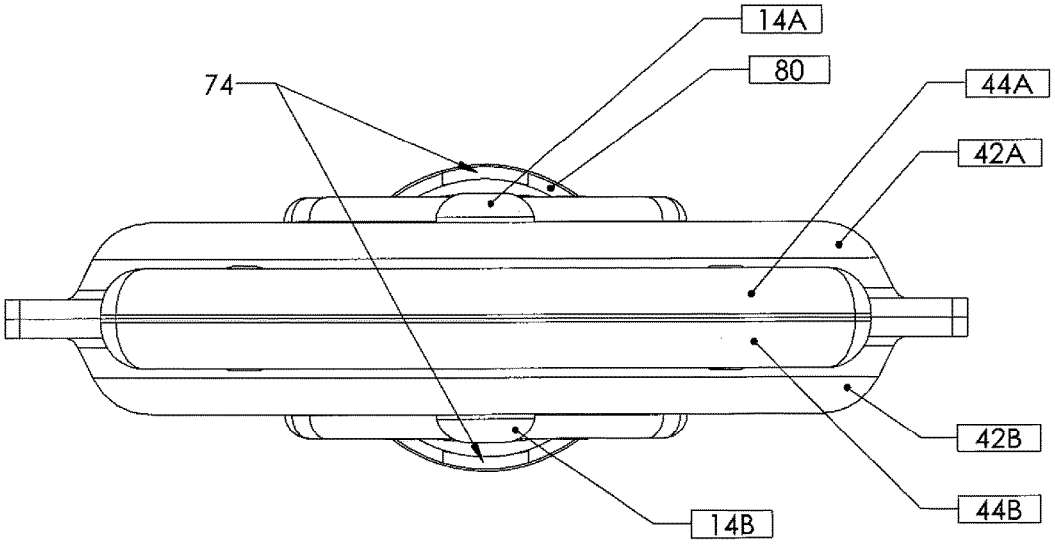
FIG. 5A is a top view of a pulley assembly in a disengaged position.
Figure 5B:
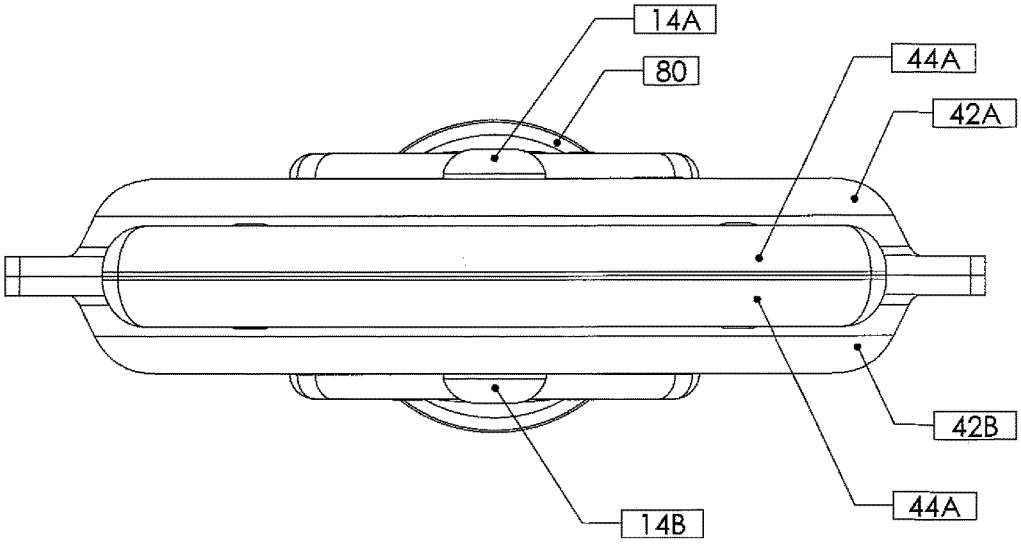
FIG. 5B is a top view of a pulley assembly in an engaged position.
Figure 6A:
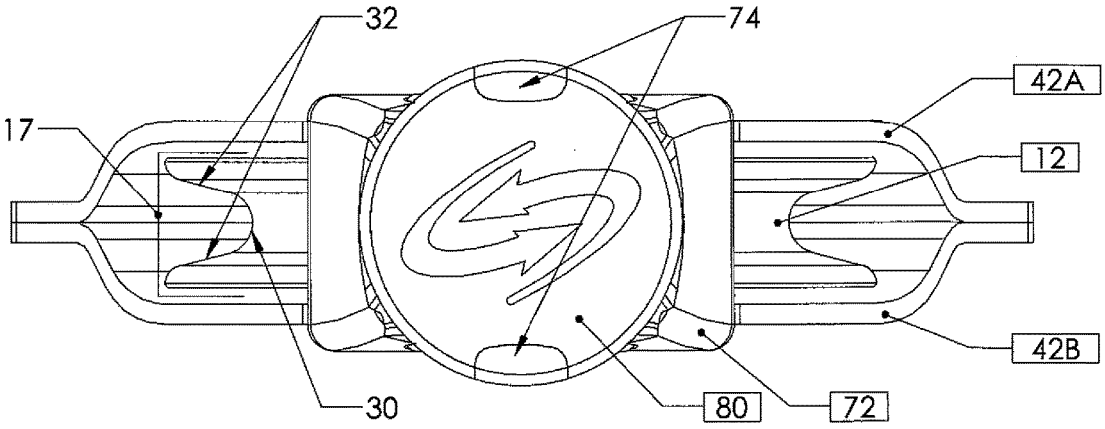
FIG. 6A is a bottom view of a pulley assembly in a disengaged position.
Figure 6B:
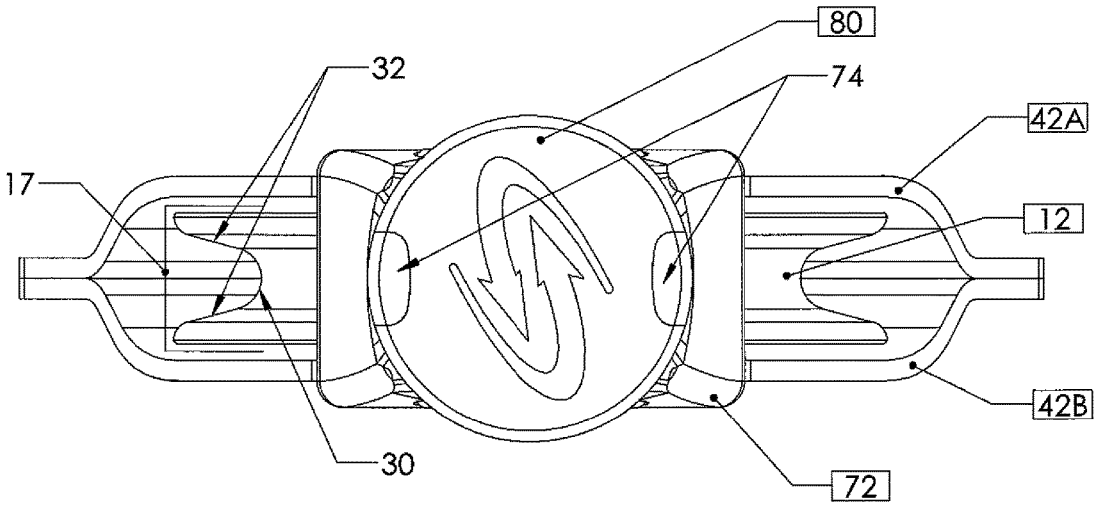
FIG. 6B is a bottom view of a pulley assembly in an engaged position.
Figure 7A:
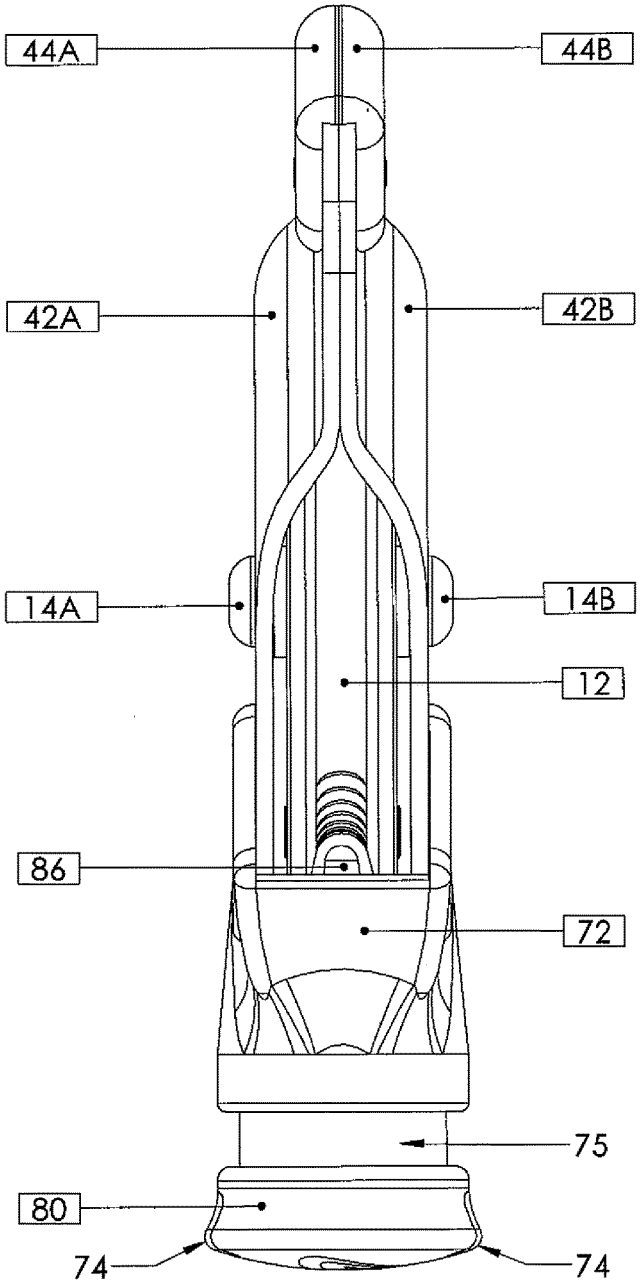
FIG. 7A is a side view of a pulley assembly in a disengaged position.
Figure 7B:
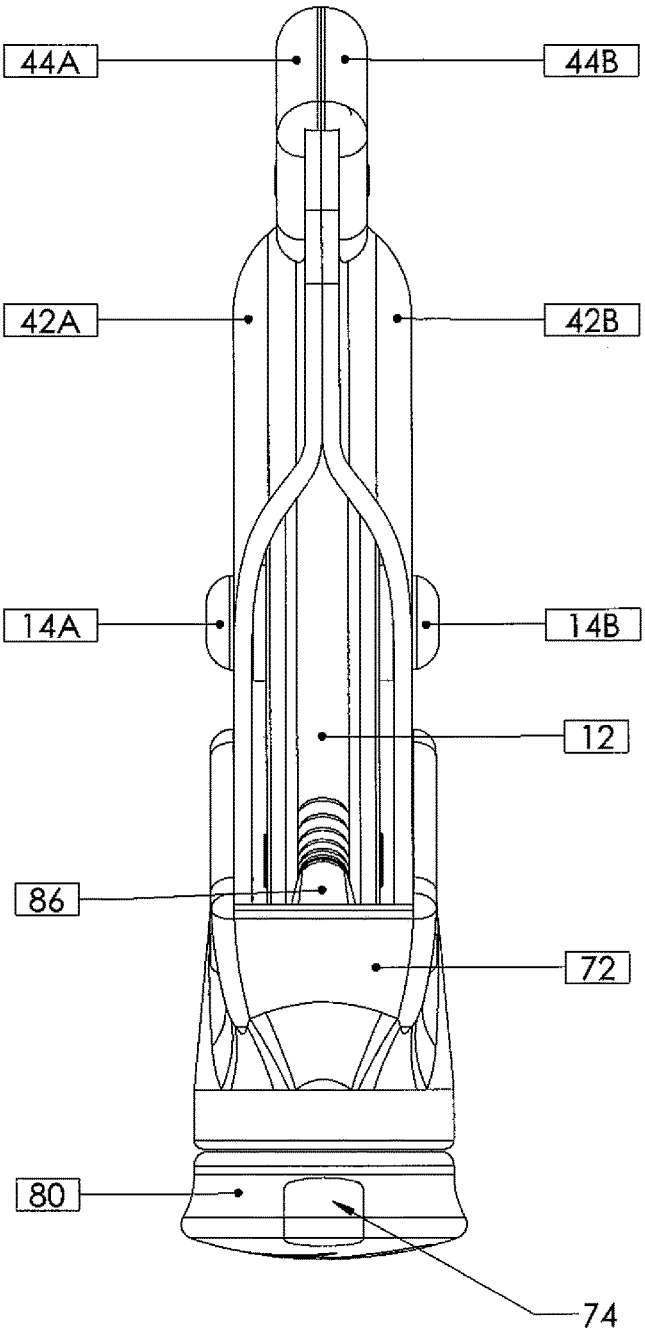
FIG. 7B is a side view of a pulley assembly in an engaged position.

As shown in FIGS. 4A and 4B, the knob 80 of the pulley engagement system 70 is positioned downward when disengaged from the pulley wheel and positioned upward when engaged or interfacing with the pulley wheel. As discussed later, it is preferred that the knob 80 of the pulley engagement system 70 may be grasped by the user and readily pulled up or down relative to the pulley assembly 10. It is also preferred that pulley engagement system include visible markings so that the user may readily discern whether the pulley engagement system 70 is in the disengaged or freely rotating position, or the engaged and non-moving position.

Figure 1A:
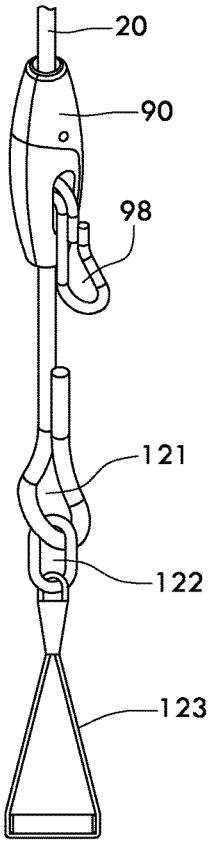
FIG. 1A is an enlarged view of several components shown in FIG. 1, where a handle is attached to an end of a pulley cord.
Figure 1B:
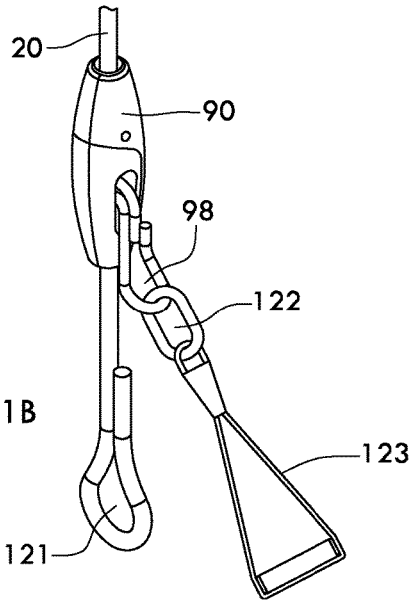
FIG. 1B is an enlarged view of several components shown in FIG. 1, where a handle is attached to an adjustment cord.
Figure 2:
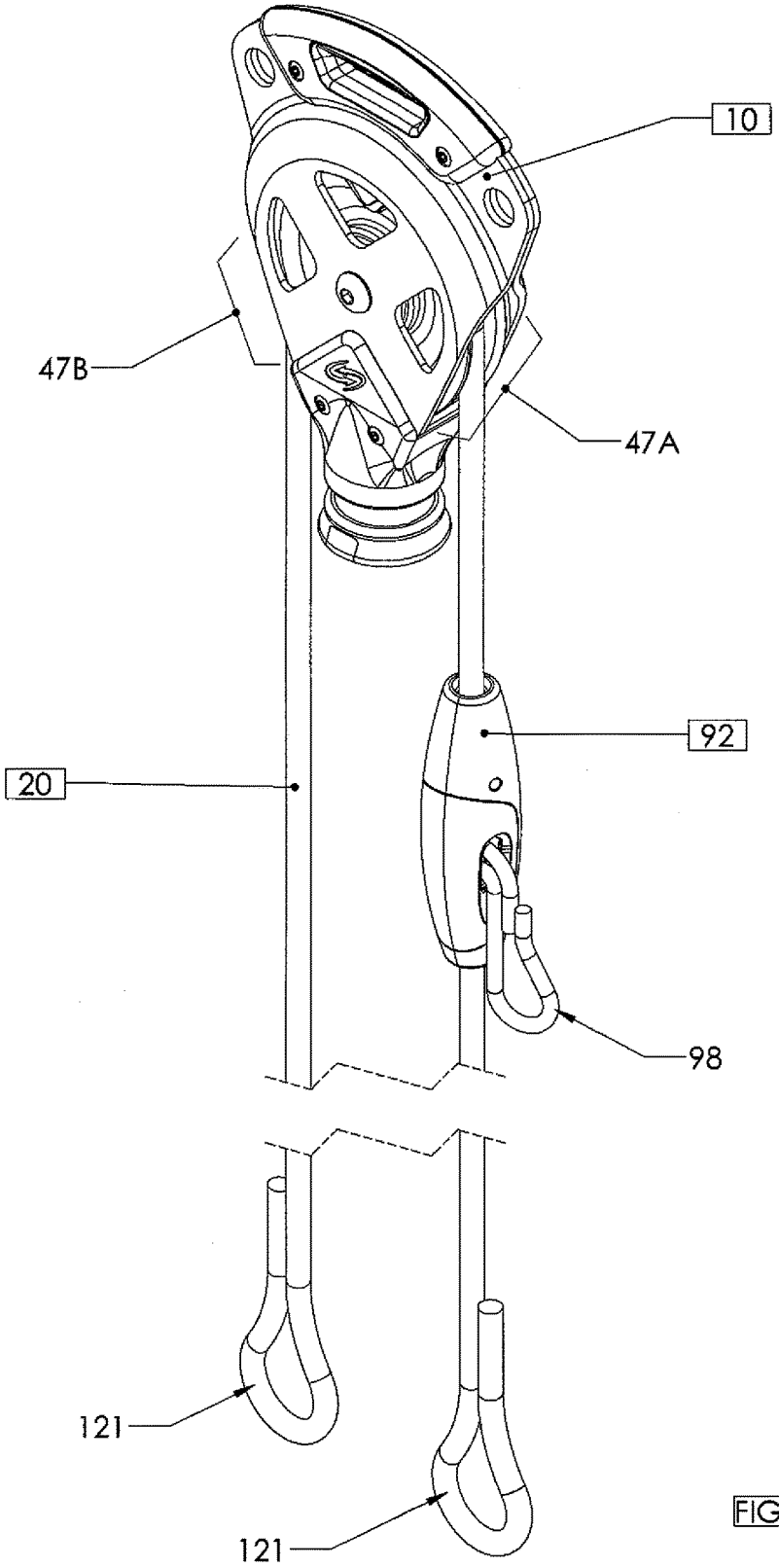
FIG. 2 is a perspective view of the training system including a pulley assembly, a pulley cord, and an adjustment cord with an enclosure or housing.
Figure 13A:
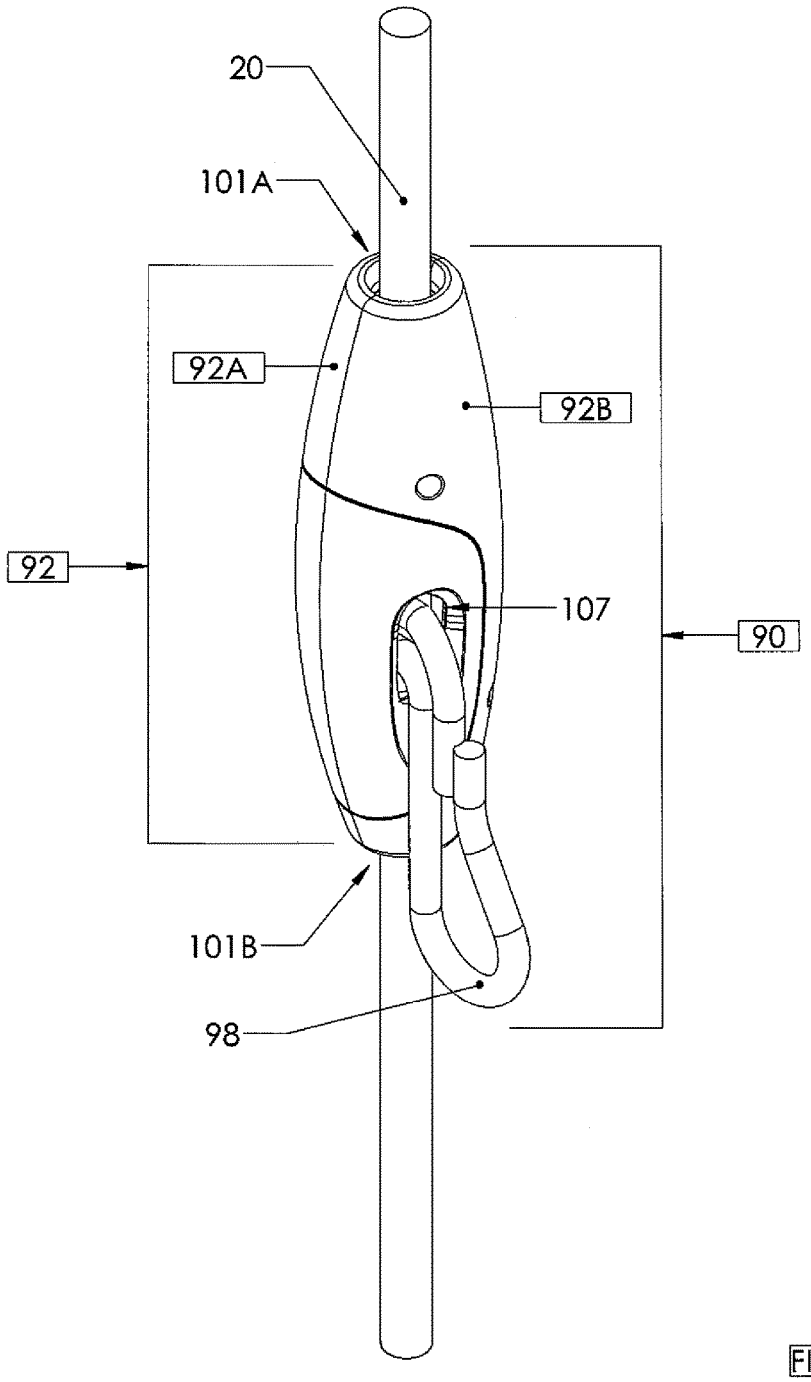
FIG. 13A shows the adjustment cord of FIG. 11 with the first and second portions of the enclosure or housing added.
Figure 13B:
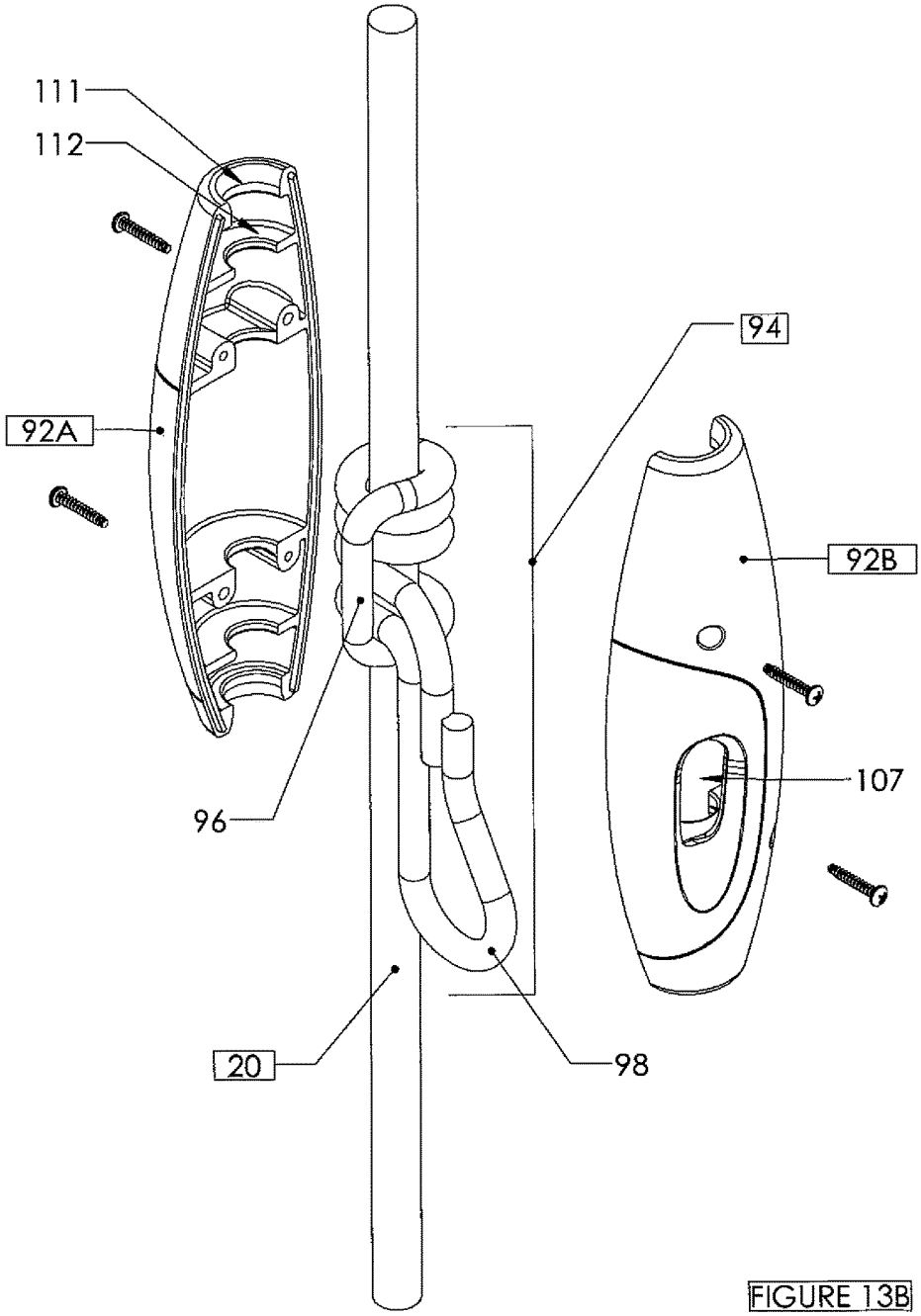
FIG. 13B shows the adjustment cord of FIG. 11 with the first and second portions of the enclosure or housing in an exploded view.

As shown in FIG. 1A, an accessory such as a handle 123 may be attached to an end of the pulley cord 20. But as shown in FIGS. 1B and 13A, the pulley cord 20 may include an adjustment device 90 that may be used to provide an alternative accessory attachment point that effectively allows the system 2 pulley cord 20 to be shortened. This is preferable to accommodate different size users, to permit different types of exercises and/or to accommodate different types of locations or heights at which the system 2 is mounted. As discussed later, the adjustment device 90 may generally include a Prusik knot 96 or other type of knot that may reside in an enclosure or housing 92. In a preferred embodiment, the adjustment device 90 may slide along pulley cord 20 to effectively lengthen or shorten the pulley cord 20.

The training system 2 may include one pulley assembly 10 as shown or multiple pulley assemblies. The pulley training system 2 may be configured to use different types of pulley cords 20, such as rope, cable, line, belt, strap, webbing, etc. Furthermore, pulley cord 20 may have a circular or non-circular cross-section. Accordingly, the use of the term "cord" does not limit the current invention to conventional cords or ropes having circular cross-sections.

As discussed later and as shown in FIG. 1, the looped ends 121 of pulley cord 20 may be fitted with handles and foot/arm cradles 123 or other attachments that may be connected by clips or carabiners 122. Also, pulley assembly 10 may include a slot or other opening 19 to accommodate a strap 18 or other supporting device so that the training system 2 may be mounted to a ceiling, wall or other location. The pulley assembly 10 may also include one or more holes 66 to accommodate clips that may permit certain types of additional exercise to be performed beyond those that directly involve the pulley wheel 12.

Figure 3A:
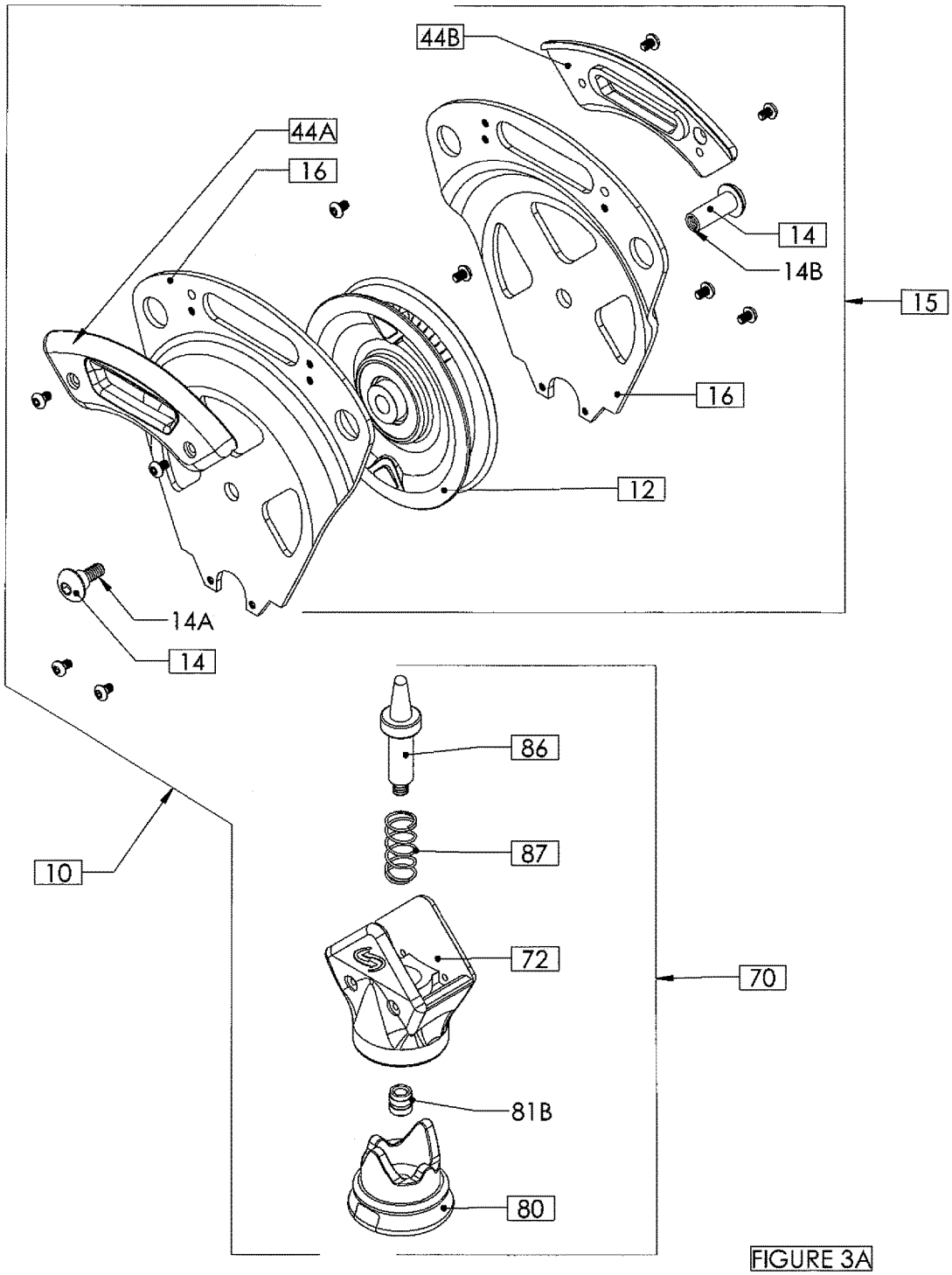
FIG. 3A is an exploded perspective view of a pulley assembly.

Referring to FIGS. 1-10, with emphasis on the exploded view of FIG. 3A, and the front views of FIGS. 4A and 4B, the pulley assembly 10 and pulley engagement system 70 are now further described. The pulley assembly 10 may include a housing assembly 15 comprising two housing parts 16 that are joined together to form an enclosure that at least partially houses the pulley wheel 12. It is preferred that at least some of the pulley wheel 12 resides within housing assembly 15 so that the user is not inadvertently injured by the pulley wheel 12 as it rotates.

Each housing part 16 may be shaped such that it contains two substantially parallel surfaces, 16A and 16B, so that when both housing parts 16 are joined together in a mirrored configuration to create a housing assembly 15, the surfaces 16A will abut one another, and a gap is formed between parallel surfaces 16B that allows sufficient space to house the pulley wheel 12 and axle assembly 14 as discussed below. As shown in the figures, there may be a curved or other type of transition portion 16D between the surfaces 16A and 16B on each housing part 16. The transition portion 16D may position surface 16A more to the interior of the housing assembly 15 than the surface 16B. At or near bottom face of each housing part 16 is a bottom portion 16C that may be attached to the pulley engagement system 70.

The pulley wheel 12 may be mounted on, and may rotate about, an axle assembly 14. The axle assembly 14 may be mounted to the housing assembly 15. The pulley wheel 12 may comprise a hard, durable material such as metal or a suitable polymer.

The axle assembly 14 may include axle portions 14A, 14B as shown, which may be joined together and which may in turn engage the pulley wheel bearing 14C to allow rotation of the pulley wheel 12. Alternatively, a single axle component may be used instead of axle portions 14A, 14B. It is preferred that at least one heavy duty bearing be used in connection with the axle assembly 14 to support the weight of the user during certain exercises. It is also preferred that the bearing 14C operate in a smooth manner to avoid binding during exercises. The axle portions 14A, 14B may be secured to the housing assembly 15 to position the pulley wheel 12 therein, and may comprise a durable material such as metal.

The housing assembly 15 is preferably made of a durable material such as aluminum or other metal, or a suitable polymer. The housing assembly 15 may be coated for resistance to a user's sweat or other corrosion. For example, the housing assembly 15 may be anodized, electroplated, or painted depending on the material used. Housing parts 16 may include graphics (embedded via laser-etching, or pad printed, or attached as a label or by other means) that may include safety, instructional and/or marketing information.

The housing assembly 15 may also include strap supports or top flanges 44A, 44B which may be attached to the faces 16A, respectively. Flanges 44A, 44B may provide improved durability to the overall housing assembly 15, as well as extra strength in accommodating a mounting strap 18. To this end, flanges 44A, 44B, as well as faces 16A, may include a slot or other opening 19, which may be aligned so that the mounting strap 18 may extend through all these components. The mounting strap 18 may be attached to a ceiling, wall, door anchor or other mounting location to support training system 2.

As shown, top flanges 44A, 44B are stationary relative to the housing assembly 15 so that the housing assembly 15 remains relatively stationary. In an alternative embodiment (not shown), however, these components may swivel relative to the housing assembly 15 to provide an extra degree of freedom of movement. In any event, the attachment strap 18 may be any suitable strong and durable material. For example, the attachment strap 18 may comprise a 1½ inch wide strong synthetic fabric, but other materials having other dimensions may be used.

The top portion 16A of housing part 16 may include one or more holes 66 that may be located at opposing sides of the flanges 44A, 44B. Holes 66 may be sized to allow convenient removable attachment of clips like those noted above. In this configuration, the pulley training system 10 may be used for certain exercises that do not require the rotation of the pulley wheel 12, such as pull ups, leg lifts or knee raises. Other hanging exercise devices, such as a boxing bag, elastic straps, or other attachments, might be hung from the first and second clips in this configuration, making the training pulley 10 a central location for exercises of many different kinds. It is preferred that holes 66 are located slightly lower than the top of housing assembly 15 so that they are more readily accessible to the user.

Figure 3B:
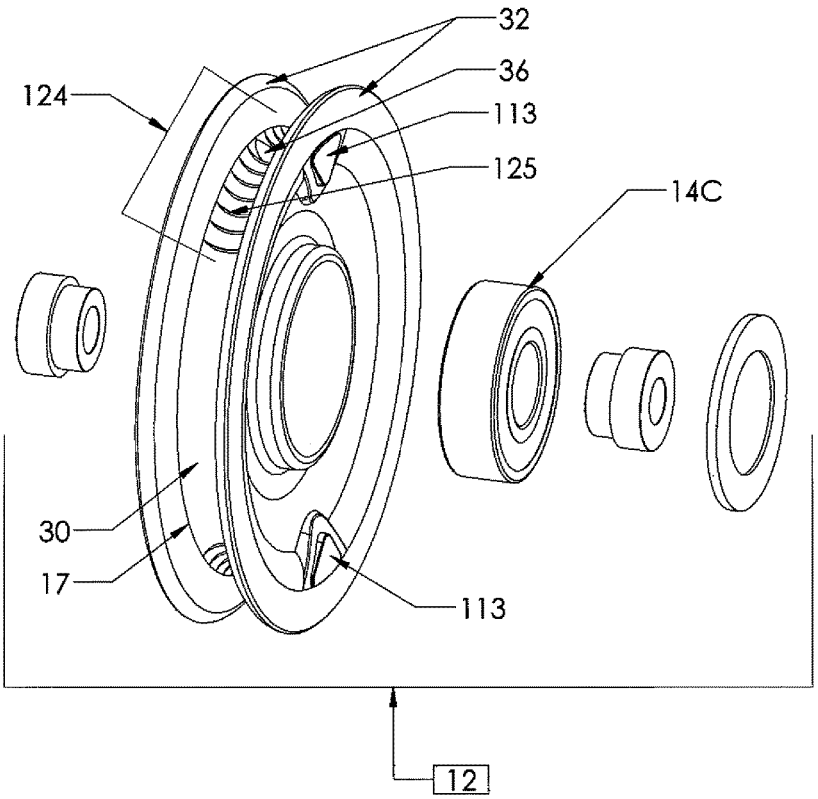
FIG. 3B is an exploded perspective view of a pulley wheel assembly.

The pulley wheel 12 is now further described with reference to FIG. 3B and other relevant figures. By way of example and without limitation, the pulley wheel may have a diameter of approximately 4½ inches and a width of approximately ¾ inch, the axle assembly 14 may be approximately two inches long and ⅜ inch in diameter.

The pulley wheel 12 includes a circumferential edge or cross-section 17 that is preferably configured to receive the pulley cord 20. In an embodiment configured for use with a pulley cord 20 having round cross-section, the circumferential edge 17 may have a concave cross-section shaped as a semi-circle or parabola. This configuration of edge 17 may be formed with two flanges 32 extending radially outward from the concave surface of the groove 30 between them. In this manner, the pulley cord 20 is preferably well seated between flanges 32 so that cord 20 is appropriately guided through openings 47A and 47B of the housing 16 and does not rub against the housing assembly 15 as the pulley 12 rotates.

As an example which is not intended to be limiting, the groove 30 may preferably have a substantially parabolic cross-section and have a depth approximately 25% to 75% greater than the diameter of the cord (e.g., 50%), and the width of the groove at its maximum extent may preferably be approximately 50% to 200% greater than the diameter of the cord (e.g., 100% greater). The configuration of each flange 32 may have a slight taper inward toward the groove 30, and the diameter of the pulley cord 20 may preferably be approximately 50% to 200% greater than the width of each flange (e.g., 100 percent greater). In an embodiment adapted for use with a cord 12 having a non-round cross-section, e.g., a v-belt or flat webbing, the groove 30 may for example have a correspondingly v-shaped or rectangular cross-section as discussed later in connection with FIGS. 16-17.

As discussed in more detail below, one or more holes 36 may be located in the groove 30 along the circumference of the pulley 12. These holes 36 along with the pulley engagement system 70 may be used to engage the pulley wheel 12 at one or more rotational positions so that it does not rotate.

The circumferential groove 30 of the pulley wheel 12 preferably may have at least one serrated, raised, or gripping section 124 at or around the position(s) of the female opening(s) or hole(s) 36 of pulley wheel 12. Gripping section 124 may comprise one or more members 125 that extend radially outward from pulley wheel 12. Members 125 may be flexible or rigid, and preferably frictionally engage cord 20 so as to prevent cord 20 from moving relative to the pulley wheel 12, when the pulley wheel 12 is in a static or engaged position, or reduce the amount of relative movement. In this manner, the pulley cord 20 is preferably well seated to substantially not slide or move over the pulley wheel 12 when the pulley engagement system 70 is engaged or non-moving.

Besides limiting or preventing relative movement between the pulley wheel 12 and the cord 20, the members 125 may also aid the user to align a hole 36 with the plunger pin 86 (which is further described below) when the user seeks to configure the pulley wheel 12 in an engaged position. That is, the friction between the plunger pin 86 and the members 125 may create noise or vibration that may apprise the user that the hole 36 is nearing the plunger pin 86 when the pulley wheel 12 is rotated to a position so that the plunger pin 86 and hole 36 may align in an engaged position.

The pulley cord 20 is now further discussed with reference to FIGS. 1, 1A, 1B and 2. The pulley cord 20 may comprise any suitably strong and durable material such as a metallic cable, or a strong synthetic or natural cord or rope. As an example not intended to be limiting, the pulley cord may be 6.5 mm to 11 mm diameter, and may generally have a circular cross-section. The use of a thicker cord 20, such as at the higher end of the foregoing diameter range, may be preferred because it provides increased durability and also complements the aesthetic appeal and appearance of the pulley assembly 10. To this end, a thicker cord 20 may contribute to the overall appearance and design attributes of the system 2 regardless of any durability it may provide. For example, the curvature of the cord 20 circumference may complement the radius of the transition portions 16D of housing parts 16.

The pulley cord 20 may include loops 121 at each of its ends which may be formed by doubling the ends of the pulley cord 20 on itself. These loops 121 may be used to receive clips 122, handles 123 or other user interface. The length of the usable portion of the pulley cord 20 may be adjusted by using the pulley cord adjustment assembly 90 as discussed in more detail later.

The pulley engagement system 70 aspect of the invention is now further described with reference to FIGS. 1-10. As noted above, the housing assembly 15 may include a pulley engagement system 70 that allows the pulley wheel 12 to be operated either in a static or non-moving mode in which the pulley wheel 12 is substantially prevented from rotating relative to the pulley housing 16, or an open or moving mode in which the pulley wheel 12 is allowed to rotate freely relative to the housing assembly 15. This advantageously increases the versatility of the training system 2 by permitting various exercises to be performed. This is a significant benefit over systems not involving a pulley wheel. That is, the training system 10 of the current invention allows exercises to be performed with a static or moving configuration.

Figure 8A:
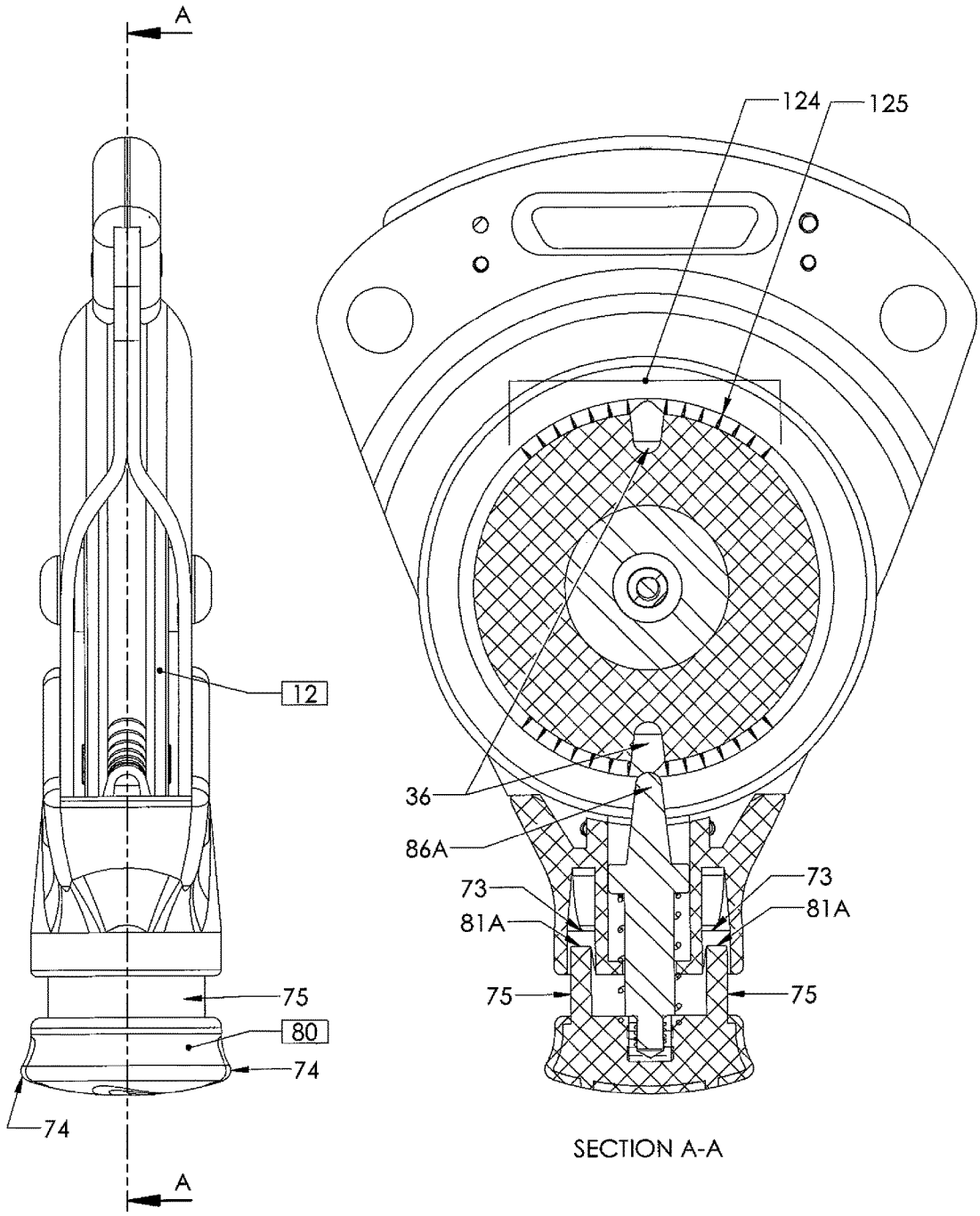
FIG. 8A is a front sectional view of a pulley assembly in a disengaged position.
Figure 10:
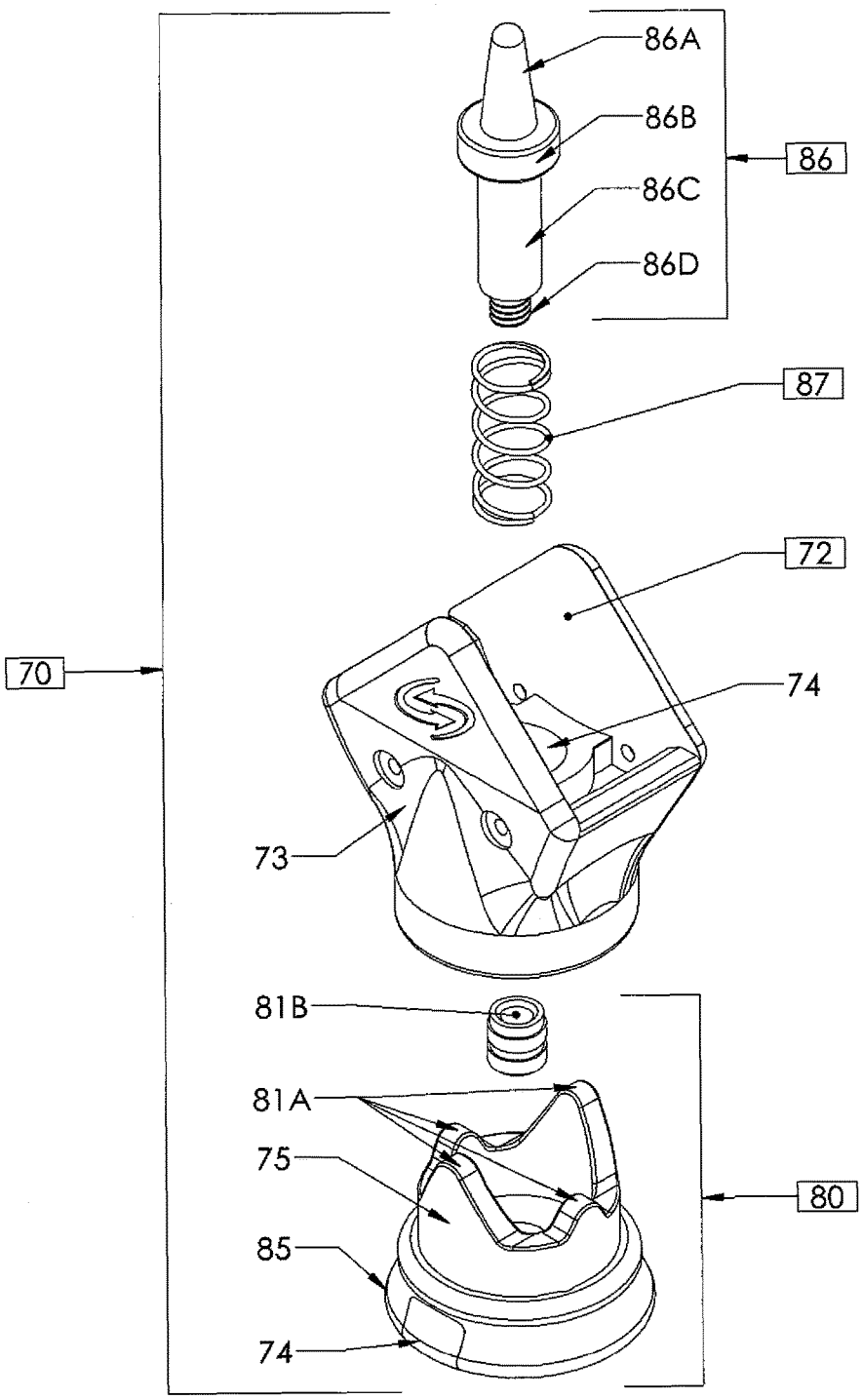
FIG. 10 is an exploded perspective view of a pulley engagement system.

The pulley engagement system 70 may be attached to the bottom portions 16C of the housing assembly 15. As shown in FIGS. 3A, 8A and 10, the pulley engagement system 70 may generally include a plunger pin housing 72, which may be the component attached to the bottom portion of the housing assembly 15. Plunger pin housing 72 may in turn include ramped receptacles 73 and a plunger pin bore or hole 74.

The pulley engagement system assembly 70 may also include a knob 80, which may be grasped by the user to disengage the plunger pin from the pulley wheel and conversely to engage or cause the plunger pin to interface with and slide into one of the holes 36 of the pulley wheel 12. As discussed in more detail later, this may occur by the user pulling down and rotating the knob 80 in either direction. The knob 80 may also include a ramped portion or ramped prongs 81A that may engage the ramped receptacles 73 of the plunger pin housing 72. As such, the ramped prongs 81A and ramped receptacles 73 act as a cam surface to raise or lower the knob 80. The knob 80 may also include an internal threaded insert 81B that may engage the threads 86D on the plunger pin 86. The bottom edge of the knob 80 may also be shaped as a flange 85 to also facilitate grasping by the user.

The pulley engagement system 70 may also include a knob 80, plunger pin 86, spring 87, and internal thread insert 81B that may move axially within the plunger pin housing bore 74. In this manner, the plunger pin 86 may engage or interface with one or more holes 36 in pulley wheel 12 to hold the pulley wheel 12 in place and prevent rotation. Conversely, the plunger pin 86 may be disengaged from the pulley wheel 12 hole 36 thereby allowing the pulley wheel 12 to rotate freely. More specifically, the plunger pin 86 may include an insertion portion 86A that may be conically shaped. It should be noted that the shape of the insertion portion 86A of plunger pin 86 may vary. Plunger 86 may also include collar 86B, barrel or cylindrical portion 86C threaded portion 86D. A spring 87 may be located between plunger pin 86 and plunger pin housing 72. The spring 87 may generally bias the plunger pin 86 upwards so that it may readily engage a hole 36 when aligned therewith.

Figure 8B:
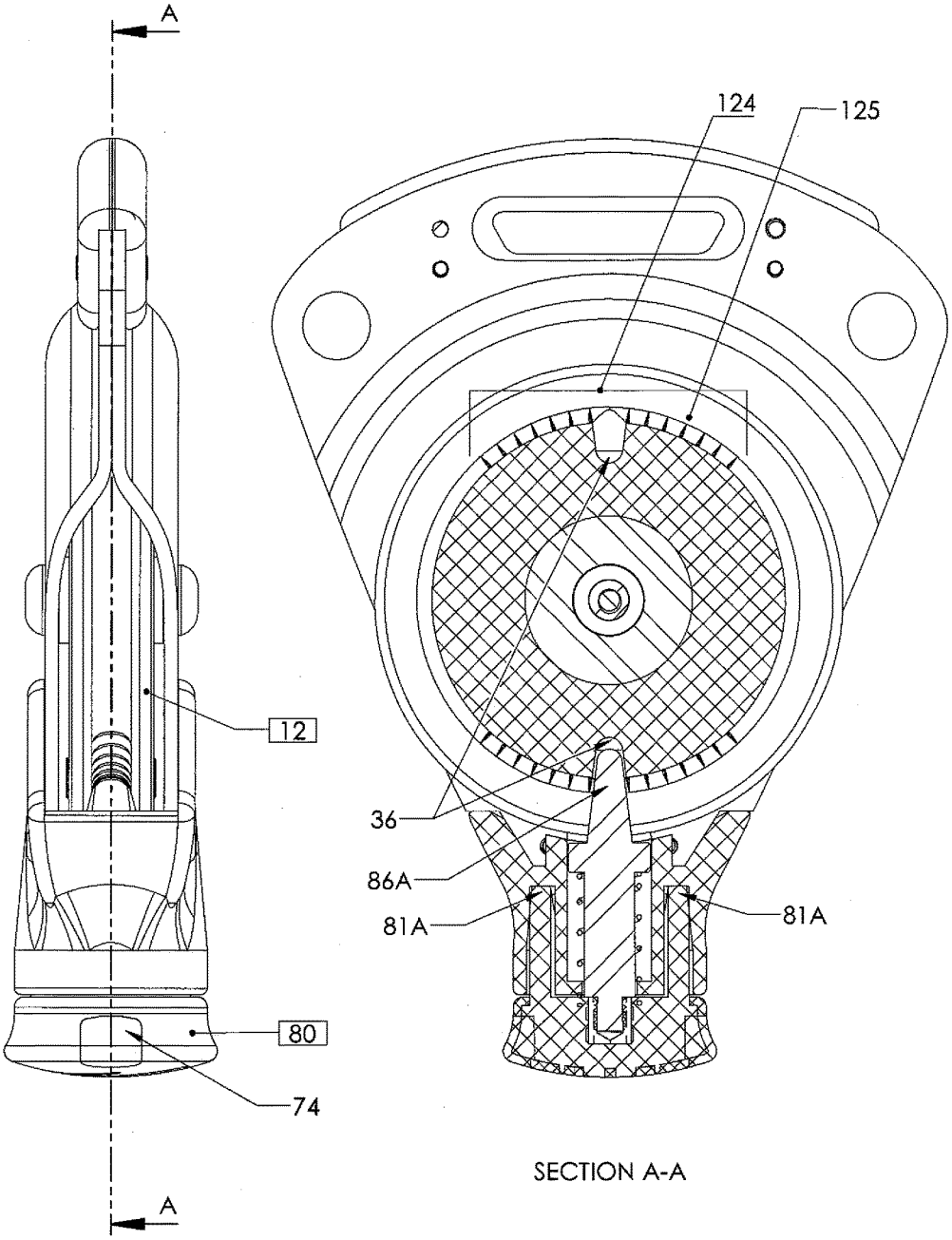
FIG. 8B is a front sectional view of a pulley assembly in an engaged position.
Figure 9A:
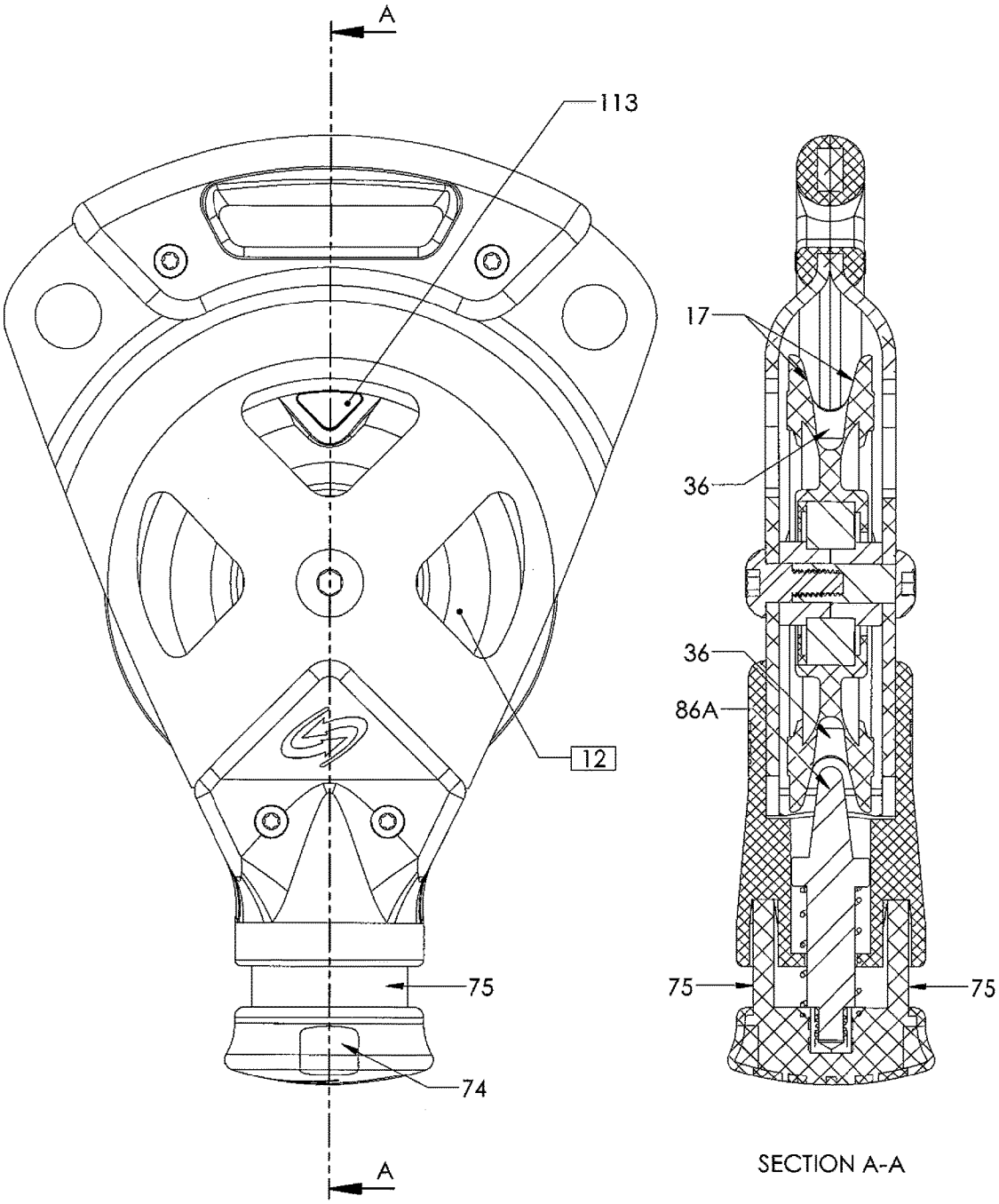
FIG. 9A is a side sectional view of a pulley assembly in a disengaged position.
Figure 9B:
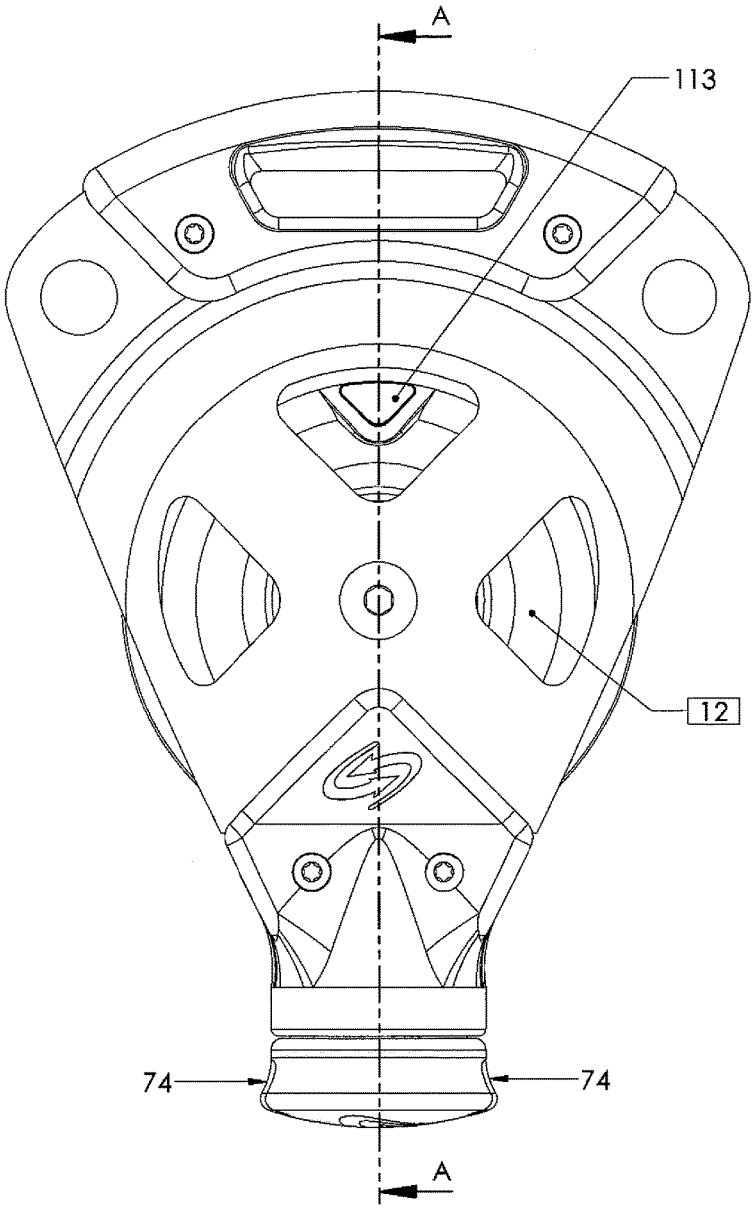
FIG. 9B is a side sectional view of a pulley assembly in an engaged position.
Figure 9B:
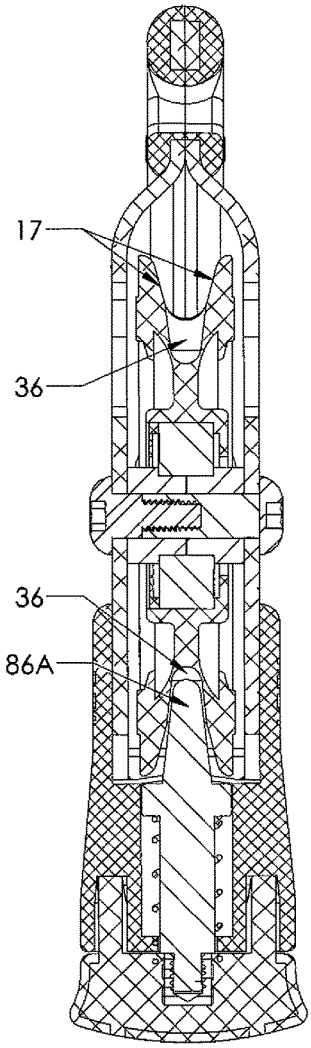

The above-referenced components, how they are attached and how they interact with the housing assembly 15 and the pulley wheel 12 are now discussed in more detail with emphasis on the sectional and exploded views of FIGS. 8A and 8B, 9A and 9B and 10. FIGS. 8A and 9A are front and side sectional views, respectively, showing pulley engagement system 70 in a disengaged non-fastened position. FIGS. 8B and 9B are front and side sectional views, respectively, showing the pulley engagement system 70 in an engaged or non-moving position. FIG. 10 is an exploded view of the pulley engagement system 70.

While plunger pin housing 72 may be fixedly attached to housing assembly 15, plunger pin 86 may be attached to knob 80 through an internal threaded insert 81B and plunger pin threads 86D. Knob 80 and thus plunger pin 86 may move up and down together through bore 74 relative to plunger pin housing 72 and pulley wheel 12 to engage and/or disengage the pulley wheel 12.

As shown, the insertion or conical portion 86A of plunger pin 86 may be located proximate to the circumferential edge 17 of the pulley wheel 12. As noted above, the surface of groove 30 around the circumferential edge 17 of the pulley wheel 12 preferably includes at least one hole 36 configured to receive the conical portion 86A. It is preferred that holes 36 be configured in a corresponding manner as insertion portions 86A, e.g., the insertion portion 86A may have a substantially conical outer profile and the inner profile of the holes 36 may be formed correspondingly. When in an engaged or non-moveable position, as shown in FIGS. 8B and 9B, this provides a secure fit and limit or prevent the rotation of wheel 12.

In order to engage or secure the pulley wheel 12 to keep it from rotating, one of the holes 36 may be aligned with the plunger pin 86 by rotating the pulley wheel 12 in the housing assembly 15. Because the plunger pin 86 (and knob 80) have a range of motion, the conical portion 86A may then extend radially into one of the holes 36. The components of the pulley engagement system 70 preferably comprise materials and dimensions so that they are strong enough to not break or deform under significant side loading such as when the user's body weight is pulling down on one end of the pulley cord 20, thereby exerting a force on the pulley engagement system 70 components. To this end, plunger pin 86 preferably is constructed of steel or other suitably strong material.

When in an interfacing position, it is preferred that the plunger insertion portion 86A does not become disengaged from hole 36, or otherwise allow the pulley wheel 12 to rotate, inadvertently, i.e., without user manipulation. To facilitate this security, the spring 87 has a sufficient modulus, or upward force, along with the conical taper angle of the pin 80, to effectively prevent unwanted disengagement. In this manner, it is preferred that knob 80 may not simply be pulled down inadvertently thereby unlocking the wheel 12. This is because simply pulling down knob 80 will not result in enough travel of plunger 86 to disengage the pulley wheel 12. Instead, it is preferred that the knob 80 is rotated while pulling down to disengage the pulley wheel 12 as discussed in more detail below. Furthermore, the spring 87 may surround plunger pin 86 and may be biased so as to urge the plunger pin 86 radially inwardly into hole 36 and towards the axle assembly 14. To this end, the spring 87 may be configured and positioned so that it abuts a plunger pin collar 86B thereby urging plunger pin 86 radially inward.

The knob 80 and the manner in which the user may manipulate it to engage or disengage the pulley wheel 12 is now further described. It is preferred that knob 80 reflect an ergonomic design for user-friendliness, as well as an aesthetically pleasing design that complements the other components of training system 2. To this end, the circular nature of knob 80 complements the circular aspects of housing 16, such as the curved nature of transition portion 16D, and contributes to the overall aesthetic appeal of the design regardless of the ergonomic function.

Knob 80 may comprise a plastic, such as polyamide, a metal or other suitable material. As shown, knob 80 may include a flange 85 that may help the user's fingers grasp the knob 80. The pulley engagement system 70 and the knob 80 preferably extend downward toward the user and may be positioned below the axle assembly 14 so that the user may grasp the knob 80 when the training system 2 is suspended above the user.

As indicated above, knob 80 is configured to move between a disengaged or lowered position as shown in FIGS. 4A, 5A, 6A, 7A, 8A and 9A, as well as an engaged or upward position as shown in FIGS. 4B, 5B, 6B, 7B, 8B and 9B. To lock the pulley wheel 12, the user may first align a hole 36 in the wheel 12 with the plunger pin 86. To this end, the user may rotate the pulley wheel 12 (such as by pulling on the pulley cord 20) until these components are aligned. The serrated or raised portions 124 may apprise the user when a hole 36 is coming into alignment with the plunger pin 86. It is preferred that the spring 87 urges the insertion portion 86A into a hole 36 as they begin to align. This is facilitated by the pointed end of the insertion portion 86A. To permit faster alignment between the plunger pin 86 and a hole 36, the pulley wheel 12 preferably includes multiple holes 36, e.g., two holes at opposite sides of the axle assembly 14. Alternatively, the pulley wheel 12 may include more holes 36. And as described above, the friction between the plunger pin 86 and the members 125 may create noise and vibration that may apprise the user of when the plunger pin is nearing a hole 36.

After the plunger pin 86 is aligned with a hole 36, the user may pull down and rotate the knob 80 in either direction so that the knob 80 and plunger pin 86 travel upward due to the engagement and pitch of the corresponding knob ramps 81B and internal ramps 73 in the plunger pin housing 72 along with the force of spring 87 acting against plunger pin collar 86B. In a preferred embodiment, the knob 80 may be rotated between 45 degrees and 135 degrees to raise the knob 80 from a lowered and disengaged position to a raised and engaged position. As the user rotates the knob 80, the plunger pin 86 may continue to be urged inwardly by the force of spring 87 acting against plunger pin collar 86B. The user may also facilitate the engagement procedure by pushing up on the knob 80 while rotating it.

Because the pulley engagement system 70 has spring tension, even if knob 80 is pulled down inadvertently from an engaged position, releasing the knob 80 without rotation will return the plunger pin 86 to its engaged position in the pulley wheel 12. It is preferred that only by pulling down and rotating knob 80, e.g., between 45 degrees and 135 degrees, and releasing knob 80 that the pulley engagement system 70 remains disengaged. Additionally, the spring tension of the pulley engagement system 70 may be used to assist with the engagement of the plunger pin 86 into pulley wheel 12 hole 36 as follows. If while pulling and rotating the knob 80, such as between 45 degrees and 135 degrees, and releasing the knob 80 when the plunger pin 86 is not aligned with a hole 36, the plunger pin end 86A will be pushed into the pulley wheel 12 groove or floor 30 by spring tension. And when the pulley wheel 12 is rotated by movement of the pulley cord 20 or by user manual rotation of the pulley wheel 12 in either direction, once plunger pin 86 aligns with one of the holes 36, the plunger pin 86 will automatically be inserted in the aligning hole 36 by spring tension. Preferably, no further user involvement is necessary to prevent further pulley wheel 12 rotation.

To unfasten the pulley wheel 12, and thereby disengage the plunger pin 86 from the hole 36 in which it resides, a user may pull down on the knob 80 against the force of spring 87 and rotate the knob 80, e.g., between 45 degrees and 135 degrees, and release knob 80. In this manner, the engagement and pitch of the corresponding knob ramps 81B and internal ramps 73 in the pulley engagement system 72 will lower the knob 80 and plunger pin 86 so that the insertion portion 86A is prevented from engaging the hole 36. In a preferred embodiment, the knob 80 may be rotated between 45 degrees and 135 degrees, to release knob 80 to lower the knob 80 from a raised and interfacing position to a lowered and disengaged position. Again, because of the required pulling, lowering, rotation, and release of knob 80 that is necessary to disengage or unfasten the pulley wheel 12, inadvertent disengagement and potential injury from the pulley wheel 12 unexpectedly rotating are preferably avoided.

The pulley engagement system 70 may also include one or more visible indicators to help the user discern whether the pulley wheel 12 is engaged and non-rotating, or disengaged and freely rotating. For example, as indicated above, the user may discern whether the knob 80 is lowered or raised, such as by viewing whether a gap exists between the knob 80 and the pulley housing 15. Additional indicators are provided by coloring various components in contrasting or different colors, e.g., black and white, red and white, black and red, etc.), and configured such that a certain color and/or at a certain location is only visible or more significantly visible when in the disengaged position. For example, a portion of the outer cylindrical barrel 75 of knob 80 may be colored red or another differentiating color, and the outside surface of knob 80 may be colored black. When knob 80 is in a lowered and in a disengaged position, the differently colored outer cylindrical portion 75 of knob 80 may become visible. When the pulley wheel 12 is secured or engaged and knob 80 is rotated upward, this red or differently colored outside cylindrical barrel 75 of knob 80 is no longer visible thereby signifying that the wheel 12 is engaged or non-rotating.

Another visible indicator may be as follows. As shown in FIGS. 4A and 4B, when the knob 80 is lowered and rotated so that the plunger pin 86 is disengaged or not secured, its contrasting color areas 74 are visible in the same plane as faces 16B of housing parts 16. When the knob 80 is rotated and the plunger pin 86 slides or moves upward, the contrasting color areas 74 are positioned perpendicularly to housing port faces 16C.

Figure 16:
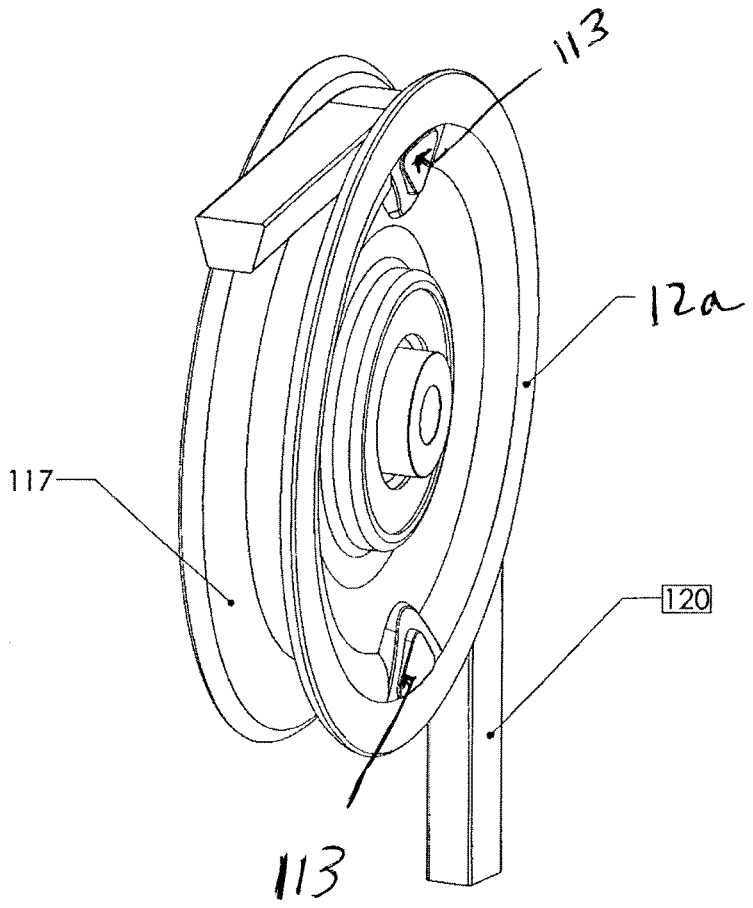
FIG. 16 is a perspective view of a pulley cord in the form of a v-belt engaging a pulley wheel having a corresponding circumferential edge.
Figure 17:
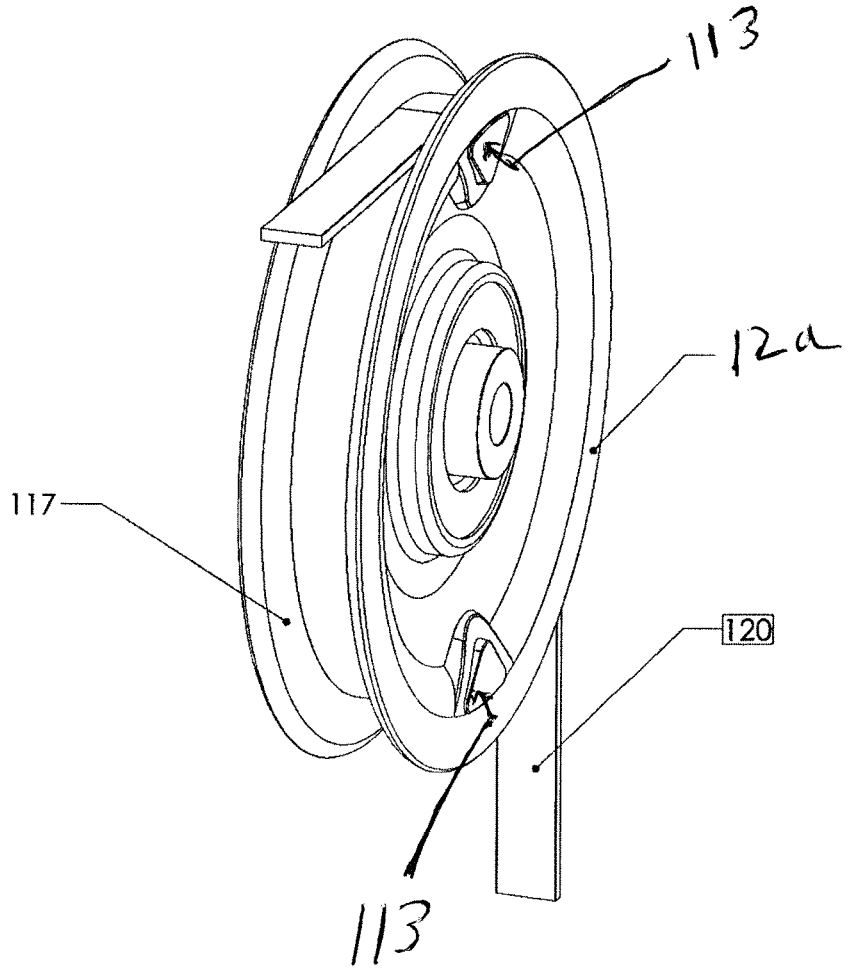
FIG. 17 is a perspective view of a pulley cord in the form of flat webbing engaging a pulley wheel having a corresponding circumferential edge.

As shown in FIG. 4B and FIGS. 16-17, a triangular or other shaped visual guide 113 may be placed on the face of the pulley wheel 12, 12*a* so that it is visible in an opening of housing part 16, thereby designating a position where a hole 36 is aligned with the plunger pin 86.

Exercises that may be performed using the training system 2 of the current invention are now further described. It is preferred that the training system 2 provides that the angle and position of a user's body may determine how much resistance the user feels, so that the same apparatus can afford a safe workout for beginners or a vigorous workout for experts. Thus, a user can perform an exercise in a static fashion (meaning that the pulley wheel 12 is substantially fixed relative to the housing assembly 15 throughout the exercise) or in a dynamic fashion (wherein the pulley wheel 12 turns on the axle assembly 14), and using his or her own body weight as resistance, or may attach a resistance strap or counter balance (such as a weight plate) to one of the ends of the cord.

The useable length of pulley cord 20 of system 2 may be adjusted to suit exercises requiring different cord lengths. In one configuration, the ends of the pulley cord 20 may be clipped together so that they can be used simultaneously for the same body part, such as supporting just one foot when one-legged squats are performed. In another configuration, two users, each holding one end of the pulley cord 20, can use the pulley training system 10 simultaneously and provide resistance to each other. Various different means can be used to adjust the length of pulley cord 20, for example a separate adjustment cord can be tied in a lanyard hitch knot onto pulley cord 20 and then clipped into a carabiner that is connected to a handle, or a Prusik knot may be used.

Another aspect of the current invention relating to an adjustment assembly 90 that may be used to vary the length of the cord 20 is now described with reference to FIGS. 11-15. The adjustment assembly 90 may include an adjustable or sliding enclosure or housing 92 and an adjustment cord 94 that may be at least partially contained within the adjustable or sliding enclosure 92. The adjustment cord 94 may include a knot, such as a Prusik knot 96 that may engage the pulley cord 20. The adjustment cord 94 may conclude with a tail end 98 that may also serve as a loop to attach a handle or other device.

Figure 11:
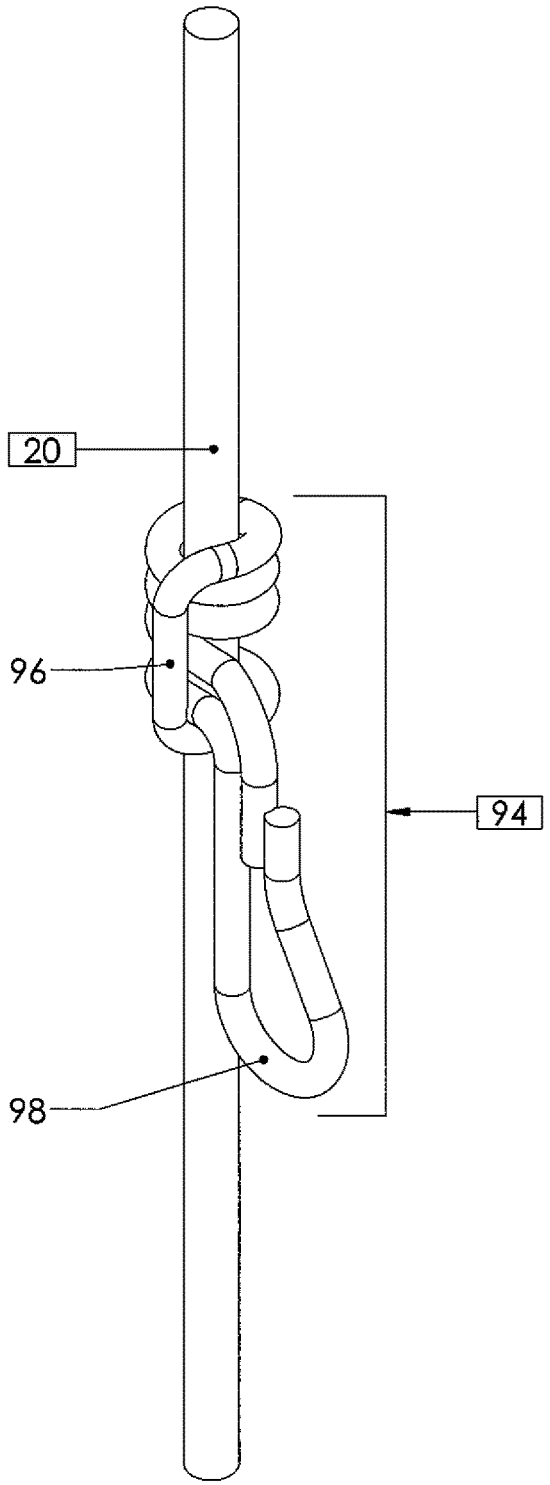
FIG. 11 shows a length of a pulley cord with an adjustment cord thereon.
Figure 12A:
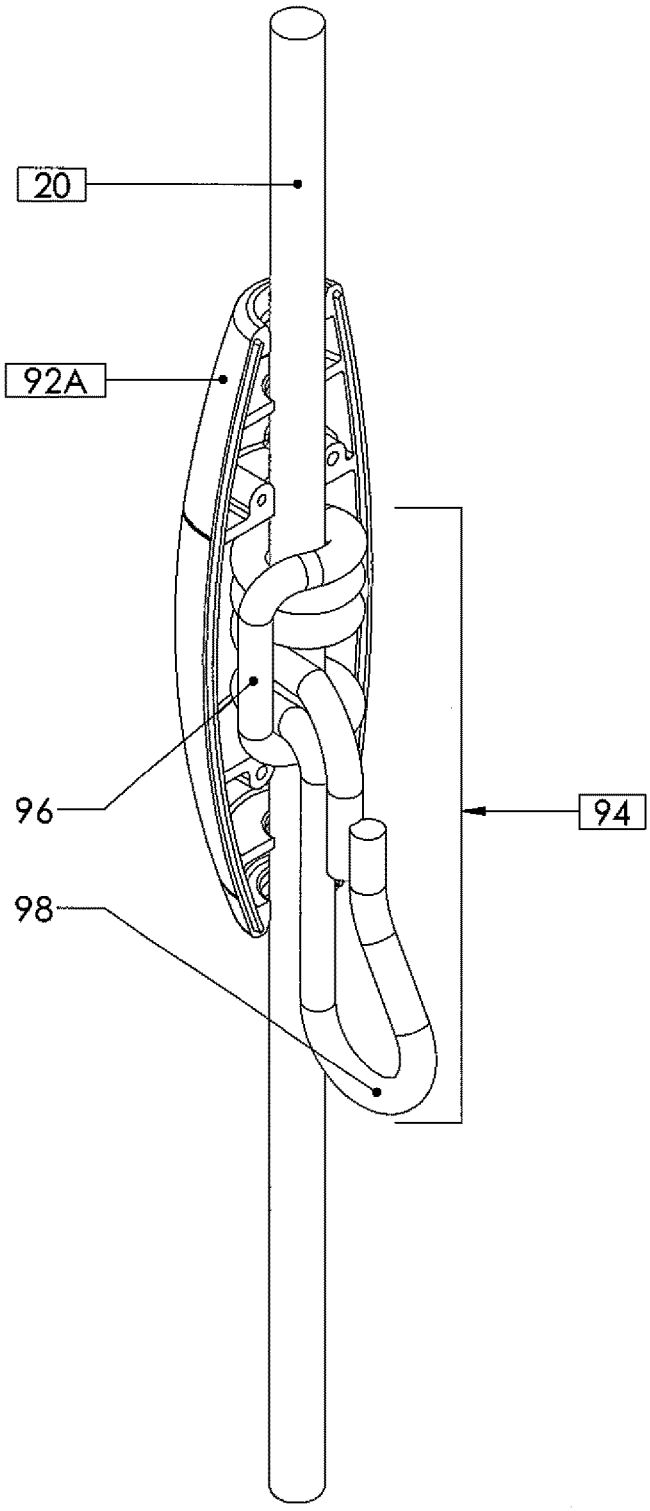
FIG. 12A shows the adjustment cord of FIG. 11 with a first portion of an enclosure or housing.
Figure 12B:
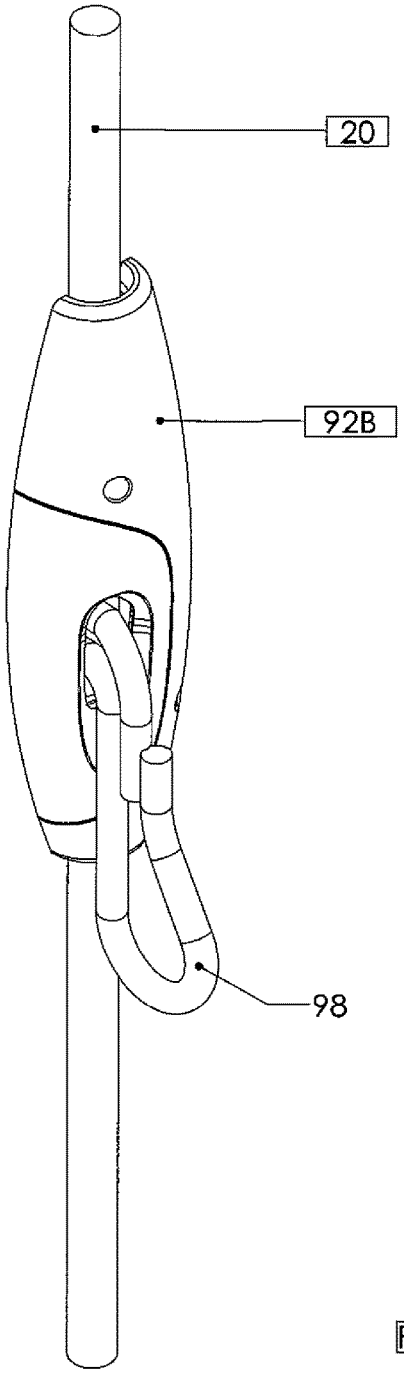
FIG. 12B shows the adjustment cord of FIG. 11 with a second portion of an enclosure or housing.

The adjustable or sliding enclosure 92 may at least partially contain, enclose and/or protect the Prusik knot 96 or other knot on the pulley cord 20 and prevent it from becoming abraded or undone or unsecured from pulley cord 20. FIG. 11 shows the adjustment cord 94 and Prusik knot 96 engaging the pulley cord 20 with the adjustable or sliding enclosure 92 removed.

The adjustment cord 94 may, for example, be formed as a single continuous loop, such as stitching or sewing together the ends of a piece of cord. The adjustment cord 94 may be placed upon the pulley cord 20 and tied in a Prusik or other knot 96 on the pulley cord 20, for example, in a triple loop or double loop Prusik knot. The adjustment cord 94 may have a diameter that is 60% to 70% smaller than the than that of the pulley cord 20. By way of example, with a pulley cord 20 having a diameter of 11 mm, an adjustment cord 94 (to be tied in a triple loop Prusik knot) may have a diameter of about 6.5 to 7 mm and a circumferential length of about 550 mm. In any event, the foregoing dimensions are only an example and are not meant to be limiting. However, it is preferred that the cord 20 and adjustment cord 94 are sized relative to each other so that the Prusik knot 96 or other knot works properly.

The adjustable or sliding enclosure 92 may comprise a hard, durable material that is preferably lightweight, such as a polymer or other suitable material. It is preferred that the adjustable or sliding enclosure 92 not be bulky or with any sharp or rough edges so as to not interfere with any exercise being performed by the user.

The adjustable or sliding enclosure 92 may be formed of two halves or portions 92A, 92B, which may be joined by screws or other suitable attachment means. Alternatively, portions 92A, 92B may be contiguously formed and connected by a hinge (not shown) on one side and latch or other similar device on the other side. In any event, other ways of constructing such an enclosure will be readily apparent to one of ordinary skill in the art.

Figure 14A:
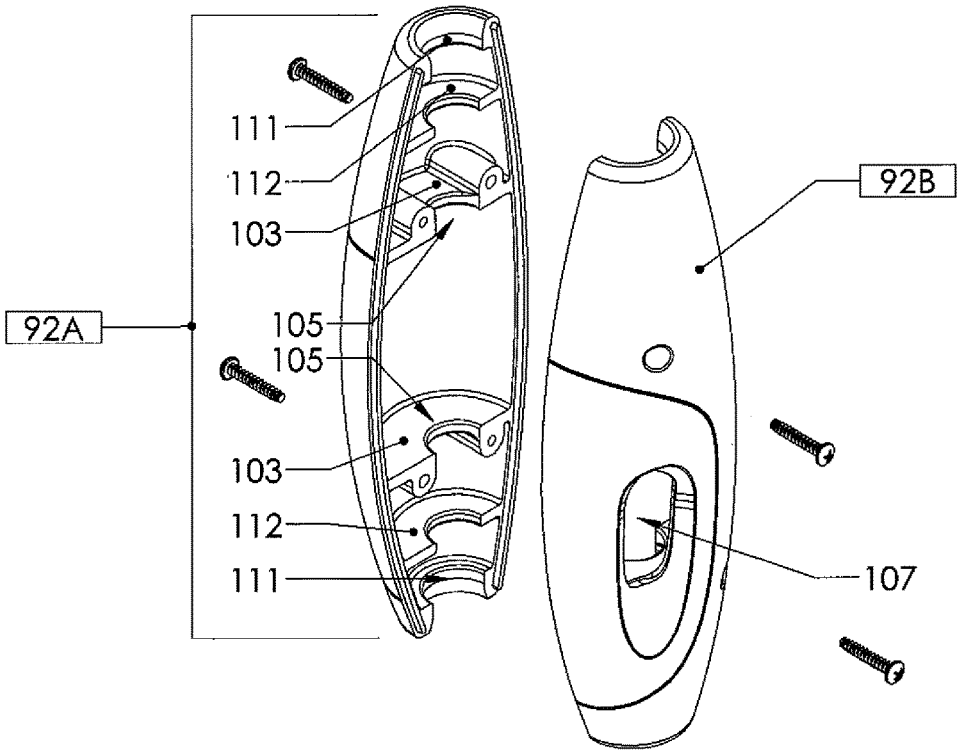
FIG. 14A is a front perspective exploded view of an adjustment enclosure.
Figure 14B:
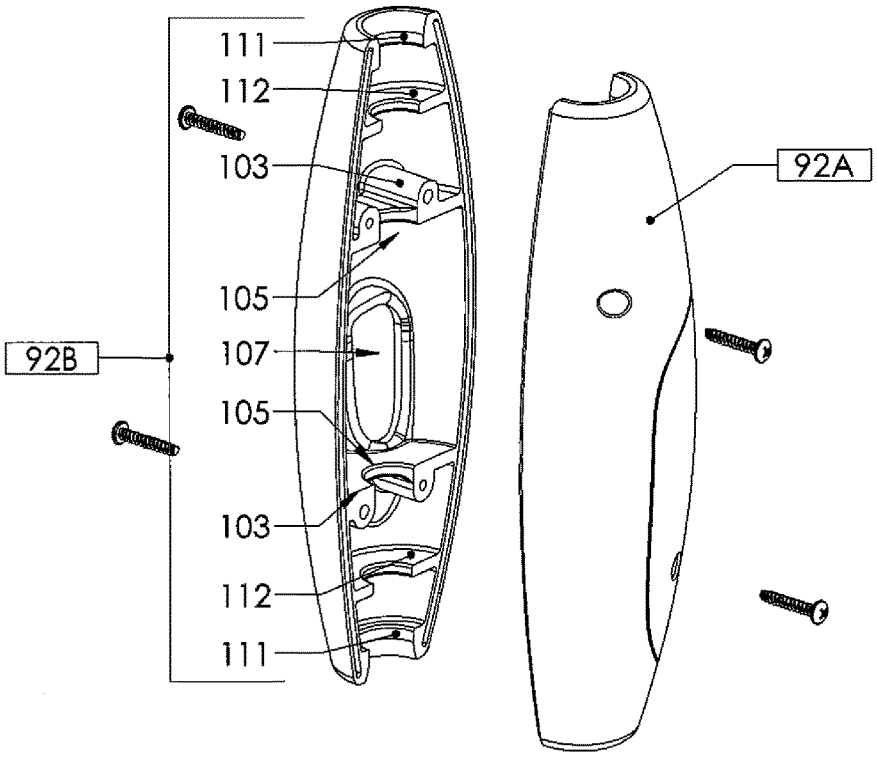
FIG. 14B is a rear perspective exploded view of an adjustment enclosure.
Figure 15A:
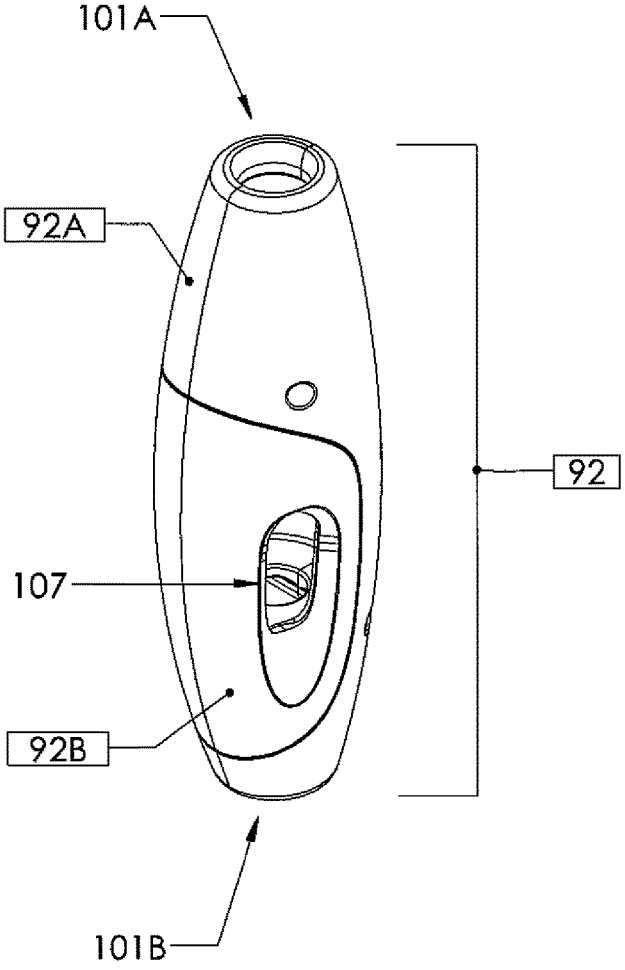
FIG. 15A is a front perspective view of an adjustment enclosure.
Figure 15B:
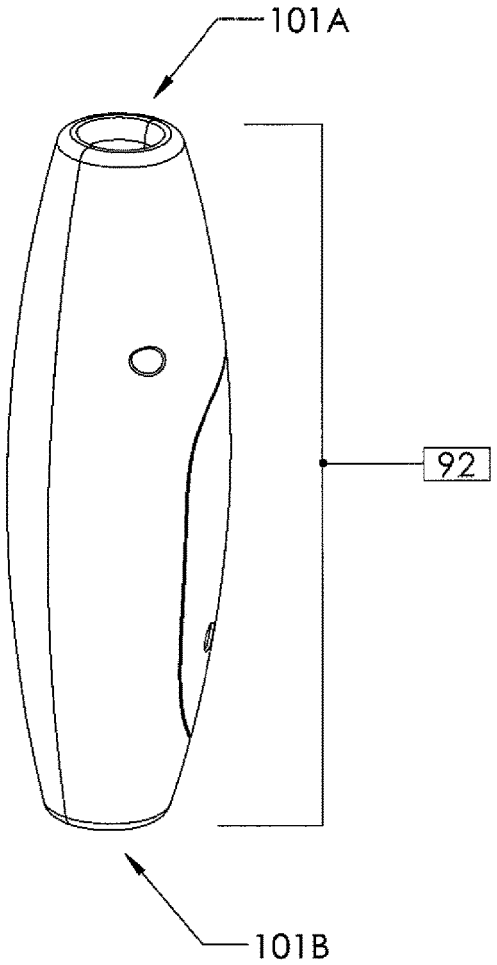
FIG. 15B is a rear perspective view of the adjustment enclosure.

The two halves 92A, 92B of the adjustable or sliding enclosure 92 both preferably include narrowed passages 101A, 101B at their top and bottom ends through which the pulley cord 20 extends. As shown in FIGS. 14A and 14B, the two halves 92A, 92B of the adjustable or sliding enclosure 92 preferably include opposing abutments 103 located and configured to allow room for the knot 96, but constrain the axial movement of the adjustable or sliding enclosure 92 relative to the knot 96 when the knot 96 is placed within the adjustable or sliding enclosure 92 and secured on pulley cord 20. Such abutments 103 may also include passages 105 through which the pulley cord 20 is threaded. In sum, the current invention includes a sturdy and capable enclosure 92 that allows the user to readily adjust the length of the pulley cord 20 to accommodate various exercises.

Each half or portion 92A, 92B of the adjustable or sliding enclosure 92 preferably includes first opposing internal structural ribs 111, 112 to reinforce the adjustable or sliding enclosure 92. This increases the overall strength of adjustable or sliding enclosure 92 and protects against situations where the adjustable or sliding enclosure 92 may hit the edge of the pulley assembly 10 at a speed that would otherwise cause damage to the adjustable or sliding enclosure 92. Additionally, opposing abutments 103, second opposing internal structural ribs 112, and first opposing internal structural ribs 111 preferably protect adjustable or sliding enclosure 92 in the case of being stepped on or dropped when the pulley system 2 is not anchored, resting on the ground, or in non-use storage. That is, ribs 111, 112 preferably provide overall structural integrity to enclosure 92.

Adjustable or sliding enclosure 92 is preferably configured to slide up and down the pulley cord 20 so that a user can conveniently select a desired location along the pulley cord 20 on which to place the knot 96. In this manner, the user may shorten or lengthen the effective useable length of the pulley cord 20, adjust the pulley cord 20 for the height of the user and/or connect the training pulley system 2 to an anchor point having a particular height. Adjustable or sliding enclosure 92 preferably includes an aperture or opening 107 through which the tail end 98 of the knot 96 may pass outside of adjustable or sliding enclosure 92. From there, the tail end 98, as shown in FIG. 1B, may, for example, be secured to a handle, foot cradle, arm cradle, or a counterweight item (such as a dumbbell, kettlebell, sandbag, etc.). If the adjustment cord 94 is a sewn- or stitched-together loop, the sewn or stitched portion is preferably positioned so that it passes out through aperture 107 and remains external to the adjustable or sliding enclosure 92, at a position other than at the distal end of the exposed loop.

In use, exerting force on a handle, foot cradle, arm cradle or the like attached to the tail end 98 of the knot 96, or exerting the weight of an attached counterweight item, causes the knot 96 within the adjustable or sliding enclosure 92 to cinch and/or frictionally secure the knot 96 and adjustment assembly 90 in place on the pulley cord 20. To move or adjust the knot 96 and adjustment assembly 90 to a new preferred height or location on the pulley cord 20, the user may disengage or cause the knot 96 to loosen from the pulley cord 20 by removing the force or weight exerted (via a handle, foot cradle, counterweight, etc.) upon the tail end 98. The user may then slide the adjustment assembly 90 up and/or slightly twisting it on the pulley cord 20 to un-cinch and/or break the frictional adhesion of the knot 96 from the pulley cord 20. The user may then apply force or weight as before to fasten or engage the knot 96 in place on the pulley cord 20.

The adjustable or sliding enclosure 92, adjustment cord 94, knot 96, aperture 107, and abutments 103 are preferably configured so that the knot 96 has enough residual friction when not loaded to hold the weight of adjustment assembly 90 in place on the pulley cord 20. However, it is preferred that the amount of residual friction may be readily overcome by a user (by sliding and/or slightly twisting the adjustable or sliding enclosure 92 on the pulley cord 20) desiring to move the adjustment assembly 90 to a new position.

The tail end 98 of adjustment cord 94 may be looped so as to permit ready attachment of a carabiner 122 (as shown in FIGS. 1A and 1B) or other attachment. However, while described here for the sake of illustration of an embodiment as a Prusik knot 96, the knot actually used may comprise any other suitable knot or other attachment that encircles the pulley cord 20, that may be secured and removed at a given position along the pulley cord 20, and that has a means of connection (e.g., a tail end) that may pass through an aperture of a suitably configured adjustable or sliding enclosure.

Referring to FIGS. 16 and 17, another aspect of the invention involving alternative configurations for the pulley cord 20 and/or pulley wheel 12 are now described. As noted above, use of the term "cord" in this application is not limited to conventional circular cross-section ropes and cords. Instead, the pulley cord 20 may comprise any suitable strong and durable pliable elongate material, that may have a circular or a non-circular cross-sectional profile.

The pulley cord 20 and corresponding pulley wheel 12, and corresponding adjustable or sliding assembly 90 are preferably adapted to accommodate the desired commercial, military, paramilitary, rehabilitative, specialty retail sales, retail and online sales, personal, recreational, home, travel or other use intended for the training system 2. For example, the pulley cord may be a metallic cable or a strong synthetic or natural cord or rope (e.g., 6.5 mm to 11 mm diameter, generally circular cross-section), a leather belt, or a nylon strap (e.g., 38 mm wide×2.0 mm to 2.4 mm thick), a flat belt, or a V-belt. A wider and differently configured pulley housing (not shown) and pulley wheel 12*a* may be desirable for use with a pulley cord 120 having a non-circular profile, with the circumferential edge 117 of the pulley wheel 12*a* being configured to accommodate the pulley cord.

In other embodiments, the cross-sectional profile of pulley cord 120 may vary and the adjustable or sliding assembly 90 preferably has openings to accommodate the cross-section of the pulley cord 20, to allow for the adjustment of the pulley cord 120. An adjustable or sliding enclosure alternative (not shown) may include a cam buckle contained within the enclosure that engages the pulley cord 120. This alternative may contain an attachment loop attached to the adjustable or sliding enclosure from which handles, foot cradles, arm cradles, or other attachments or counterweights may be attached for use during various exercises. This adjustable or sliding enclosure may also protect the user from scraping, scratching or erroneous clamping or biting of user's skin or body during exercise use.

In other embodiments, the pulley housing could be widened to accommodate two or more pulley wheels within the housing, so that a user could perform multiple pulley-based exercises simultaneously using only one housing. Alternatively, a plurality of users could perform pulley-based exercises simultaneously using the same housing. Multiple pulleys inside the pulley housing could be arranged side by side, one in front of the other, one in back of the other, or in another suitable arrangement. In other further embodiments, the pulley wheel may be replaced with a series of small pulley wheels or rollers mounted in an arc within the pulley housing.

The flexibility and versatility of the training system 2 is now further described with reference to the various exercises that it may be used to perform. With a multiple pulley system, the exercises that may be performed are expanded into more extensive group and/or team exercises. A two pulley system may be used by two or more users working in tandem or separately from each other. Further, a multiple pulley system will allow for multiple types of exercises to occurring on the system at one time thereby expanding the exercise modality offerings of the facility hosting such group and/or team exercises. Other exercise systems have not offered such multiple modality offerings via a multiple pulley system in prior experience.

As noted in the foregoing description, the various components comprising training system 2 reflect a unique and aesthetically pleasing shape, style and overall appearance. To this end, the housing assembly 15 has a smooth and free flowing appearance. The pulley engagement system 70 is proportional to the pulley assembly 10 and its dimensions and curvature also complement the housing assembly 15. The dimensions and curvature of the adjustable or sliding enclosure 92 for adjustment of the length of the pulley cord 20 is also designed to complement the aesthetic of the pulley training system 2 regardless of it ergonomic benefits.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A training system having a training pulley, comprising:

a) a pulley housing;

b) a pulley wheel rotatably connected to the pulley housing and having a circumferential edge configured to receive a cord, the circumferential edge including at least one hole to receive an engagement member;

c) wherein the engagement member is movably attached to the pulley housing and has a range of motion that extends radially into and out of engagement with the at least one hole when the pulley wheel is rotated to a position in which the at least one hole is aligned with the engagement member; and d) a pulley engagement system configured to secure the engagement member relative to the pulley housing when the engagement member is engaged with a hole on the pulley wheel.

2. The training system of claim 1, wherein the engagement member includes an insertion region having a diameter, and wherein the diameter of said insertion region decreases along a length of said insertion region in a distal direction.

3. The training system of claim 1, wherein the at least one hole is positioned 180 degrees apart from a second hole on the circumferential edge of the pulley wheel.

4. They training system of claim 1, wherein the circumferential edge of the pulley wheel includes at least one serrated, raised, or gripping section near the at least one hole.

5. The training system of claim 1, wherein the pulley engagement system includes a spring that urges the engagement member radially inward.

6. The training system of claim 1, wherein the pulley engagement system includes a knob.

7. The training system of claim 6, wherein the knob is configured to rotate between a position wherein the engagement member is engaged with a hole in the pulley wheel, and a position wherein the engagement member is not engaged with a hole in the pulley wheel.

8. The training system of claim 7, wherein the pulley engagement system includes a visible indicator that presents a different appearance when the engagement member is engaged with a hole in the pulley wheel than when it is not engaged with a hole in the pulley wheel.

9. The training system of claim 7, wherein the pulley wheel includes at least one visible indicator to guide a user to rotate the pulley wheel to a position where the engagement member and a hole on the pulley wheel are effectively aligned.

10. The training system of claim 7, wherein the pulley engagement system includes at least one indicator to show a current state of engagement or disengagement of the pulley engagement system.

11. The training system of claim 1, wherein the pulley housing includes a front face and a rear face, and the pulley engagement system is fixedly attached to both the front face and the rear face.

12. The training system of claim 1, wherein the pulley housing has a top portion including a support attachment point, and a bottom portion, wherein the pulley engagement system is attached to the bottom portion.

13. The training system of claim 12, wherein the pulley housing includes two open regions between the top portion and the bottom portion, wherein the open regions are configured to allow passage of the cord through a first open region of the pulley housing.

14. A training system having a training pulley and an adjustable or sliding enclosure, the training pulley comprising:

a pulley housing;

a pulley wheel rotatably connected to the pulley housing and having a circumferential edge configured to receive a cord, the circumferential edge including at least one hole to receive an engagement member;

wherein the engagement member is movably attached to the pulley housing and has a range of motion that extends radially into and out of engagement with the at least one hole when the pulley wheel is rotated to a position in which the at least one hole is aligned with the engagement member; and a pulley engagement system configured to secure the engagement member relative to the pulley housing when the engagement member is engaged with a hole on the pulley wheel;

wherein the adjustable or sliding enclosure comprises:

a housing having a top end and a bottom end each with a passage for a pulley cord;

an internal cavity and opposing abutments configured to receive and contain a cord adjusting mechanism, wherein the cord adjusting mechanism includes a Prusik knot or other securing knot; and wherein the Prusik knot or other securing knot is fully contained within the housing.

15. The training system of claim 14, wherein the adjustable or sliding enclosure has a section of an adjustment cord encircling a portion of the pulley cord passing through the internal cavity; and an aperture configured to receive a portion of the adjustment cord.

16. The training system of claim 14, wherein the portion of the adjustment cord received through the aperture is a tail end having a loop.

17. A pulley training system, comprising:

a pulley housing, and a pulley wheel rotatably connected to the pulley housing and having a substantially flat circumferential edge configured to receive a cord within a first region of the pulley housing during use of the pulley training system, the circumferential edge adapted to receive a cord having a cross-sectional profile that is substantially non-circular; and the circumferential edge includes at least one hole to receive an engagement member, the engagement member is movably attached to the pulley housing and has a range of motion that extends radially into and out of engagement with the at least one hole when the pulley wheel is rotated to a position in which the at least one hole is aligned with the engagement member.

18. The pulley training system of claim 17, wherein the cord having a cross-sectional profile that is substantially non-circular has an adjustable or sliding enclosure alternative that adjusts the cord.

* * * * *